US006719423B2

(12) United States Patent
Chowdry et al.

(10) Patent No.: US 6,719,423 B2
(45) Date of Patent: Apr. 13, 2004

(54) INK JET PROCESS INCLUDING REMOVAL OF EXCESS LIQUID FROM AN INTERMEDIATE MEMBER

(75) Inventors: Arun Chowdry, Pittsford, NY (US); Thomas Nathaniel Tombs, Brockport, NY (US); John Walter May, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 68 days.

(21) Appl. No.: 09/973,239

(22) Filed: Oct. 9, 2001

(65) Prior Publication Data

US 2003/0067528 A1 Apr. 10, 2003

(51) Int. Cl.[7] ..... B41J 2/01
(52) U.S. Cl. ..... 347/103
(58) Field of Search ..... 347/101–103, 347/95

(56) References Cited

U.S. PATENT DOCUMENTS 5,365,261 A * 11/1994 Ozawa et al. ..... 347/103
5,805,191 A * 9/1998 Jones et al. ..... 347/103
5,841,456 A * 11/1998 Takei et al. ..... 347/103
6,196,674 B1 * 3/2001 Takemoto ..... 347/103

* cited by examiner

*Primary Examiner*—Stephen D. Meier
*Assistant Examiner*—An H. Do
(74) *Attorney, Agent, or Firm*—Lawrence P. Kessler

(57) ABSTRACT

Apparatus and method of making an ink-jet-ink-derived material image on a receiver. An ink jet device is used to form a colloidal ink image on a member. The ink for use in the ink jet device includes an aqueous-based colloidal dispersion of particles and a nonaqueous colloidal dispersion of particles. The ink for use in the ink jet device includes an aqueous-based colloidal dispersion of particles, a nonaqueous colloidal dispersion of particles. The particles of the colloidal ink image are caused to become concentrated adjacent an operational surface of the member. Excess liquid is removed from the particles so as to form an ink-jet-ink-derived material image. The ink-jet-ink-derived image is then transferred from the operational surface of the intermediate member to another member, which another member may be a receiver member, a drum or a web.

64 Claims, 13 Drawing Sheets

INK DROPLETS DEPOSITED

IMAGE CONCENTRATED

EXCESS LIQUID REMOVED

INK JET PROCESS INCLUDING REMOVAL OF EXCESS LIQUID FROM AN INTERMEDIATE MEMBER

CROSS-REFERENCE TO RELATED APPLICATIONS

Reference is made to the following commonly-assigned co-pending applications:

U.S. patent application Ser. No. 09/973,244, filed on Oct. 9, 2001 entitled: INK JET IMAGING VIA COAGULATION ON AN INTERMEDIATE MEMBER by John W. May, et al, and U.S. patent application Ser. No. 09/973,228, filed on Oct. 9, 2001 entitled: IMAGING USING A COAGULABLE INK ON AN INTERMEDIATE MEMBER by John W. May et al., the disclosures of which are incorporated herein.

FIELD OF THE INVENTION

The invention relates in general to image recording and printing in an apparatus including an ink jet device for forming a particulate ink image on an member. In particular, ink particles in a liquid ink image on the member are concentrated by an applied field, a mechanism is provided for selectively removing excess liquid from the concentrated particles, and the concentrated particles are subsequently transferred to a receiver.

BACKGROUND OF THE INVENTION

High resolution digital input imaging processes are desirable for superior quality printing applications, especially high quality color printing applications. As is well known, such processes may include electrostatographic processes using small-particle dry toners, e.g., having particle diameters less than about 7 micrometers, electrostatographic processes using nonaqueous liquid developers (also known as liquid toners) in which particle size is typically of the order of 0.1 micrometer or less, and ink jet processes using nonaqueous or aqueous-based inks. The less commonly used nonaqueous ink jet technology has an advantage over aqueous-based ink jet technology in that an image formed on a receiver requires relatively little drying energy and therefore dries relatively rapidly.

The most widely used high resolution digital commercial electrostatographic processes involve electrophotography. Although capable of high process speeds and excellent quality printing, electrophotographic processes utilizing dry or liquid toners are inherently complicated, and require expensive, bulky and complex equipment. Moreover, due to their complex nature, electrophotographic processes and electrophotographic machines tend to require significant maintenance.

Digital ink jet processes have the inherent potential to be simpler, less costly, and more reliable than digital electrophotographic processes. Generally, it is usual for ink to be fed through a nozzle, the diameter of which nozzle being a major factor in determining the droplet size and hence the image resolution on a recording surface. There are two major classes of ink jet printing, namely, continuous ink jet printing and drop-on-demand ink jet printing. Continuous printing utilizes the nozzle to produce a continuous stream of electrically charged droplets, some of which droplets are selectively delivered to the recording surface, the remainder being electrostatically deflected and collected in a sump for reuse. Drop-on-demand ink jet printing produces drops from a small nozzle only as required to generate an image, the drops being produced and ejected from the nozzle by local pressure or temperature changes in the liquid in the immediate vicinity of the nozzle, e.g., using a piezoelectric device, an acoustic device or a thermal process controlled in accordance with digital data signals. In order to produce a gray scale image, variable numbers of drops are delivered to each imaging pixel. Typically, an ink jet head of an ink jet device includes a plurality of nozzles. In most commercial ink jet systems, aqueous-based inks containing dye colorants in relatively low concentrations are used. As a result, high image densities are difficult to achieve, image drying is not trivial, and images are not archival because many dyes are disadvantageously subject to fading. Moreover, the quality of an aqueous-based ink jet image is strongly dependent upon the properties of the recording surface, and will for example be quite different on a porous paper surface than on a smooth plastic receiver surface. By contrast, the quality of an electrophotographic toner image is relatively insensitive to the recording surface, and the toner colorants in both dry and liquid electrophotographic developers are generally finely divided or comminuted pigments that are stable against fading and able to give high image densities.

To overcome problems associated with fading and low image densities associated with dyed aqueous-based inks, pigmented aqueous-based inks have been disclosed in which a pigmented material is colloidally dispersed. Typically, a relatively high concentration of pigmented material is required to produce the desired highest image densities (Dmax). Exemplary art pertaining to pigmented aqueous-based inks includes the recently issued Lin et al. patent (U.S. Pat. No. 6,143,807) and the Erdtmann et al. patent (U.S. Pat. No. 6,153,000). Generally, pigmented inks have a much greater propensity to clog or modify the opening jet(s) of a drop-on-demand type of ink jet head than do dyed inks, especially for the narrow diameter jets required for high resolution drop-on-demand ink jet imaging, e.g., at 600 dots per inch. Drop-on-demand printers do not have a continuous high pressure in the nozzle, and modification of the nozzle behavior by deposition of pigment particles is strongly dependent on local conditions in the nozzle. In continuous ink jet printers using pigmented inks, the relatively high concentrations of pigment typically affects the droplet breakup which tends to result in nonuniform printing.

Pigmented nonaqueous inks having particle sizes smaller than 0.1 micrometer for use in ink jet apparatus are disclosed in the Romano et al. patent (U.S. Pat. No. 6,053,438), and the Santilli et al. patent (U.S. Pat. No. 6,166,105).

A deficiency associated with most high resolution conventional ink jet devices that deposit ink directly on to a (porous) paper receiver sheet is an unavoidable tendency for image spreading, with a concomitant resulting degradation of resolution and sharpness of the image produced. As a drop of deposited liquid ink is absorbed, capillary forces tend to draw the ink along the surface and into the microchannels between paper fibers, thereby causing a loss of resolution. Inasmuch as the colorant concentration of a dyed aqueous-based ink tends to be low, there is a comparatively large proportion of liquid vehicle which must be absorbed from each drop. This also holds true for the case of pigmented aqueous-based inks, for which particle sizes may be sub-micron, i.e., such very small particles can be swept along by the carrier liquid as it spreads in the paper, thereby compromising high resolution imaging quality. In addition to capillary spreading by liquid absorption in a receiver, spreading may also be a problem if the carrier liquid is not readily absorbed by a receiver, e.g., if the receiver is a coated specialty paper used in a high resolution conventional ink jet device that deposits ink directly on to a receiver. The spreading is strongly dependent upon the surface energies of the coating on the paper and of the ink. Unusual particle size distributions such as disclosed in the above-cited Lin et al. patent (U.S. Pat. No. 6,143,807) may be useful with pigmented aqueous-based inks, perhaps to mitigate the effects of image spread.

An intermediate transfer element or member may be used with an ink jet device in which device one or more colored inks may be deposited via ink jet on to the surface of the intermediate and subsequently co-transferred to a receiver such as a paper sheet. In the Anderson patent (U.S. Pat. No. 5,099,256) an intermediate member having a thermally conductive silicone surface that is rough to prevent image spreading is heated to dehydrate an aqueous-based ink jet image formed thereon prior to transfer of the ink jet image to a receiver. The Okamato et al. patent (U.S. Pat. No. 5,598,195) discloses an ink jet recording method, in which a voltage pulse applied to an electrode in an ink jet recording head and an opposing electrode disposed on the opposite side of an intermediate recording material produces a Coulomb force that causes an ink to be jetted on to the intermediate recording material. The Xu patent (U.S. Pat. No. 5,746,816) discloses an aqueous liquid ink containing an insoluble dye. Such an ink containing an insoluble dye is used in the Hale et al. patent (U.S. Pat. No. 5,830,263) which discloses a method in which a liquid ink containing a heat activated dye is imagewise deposited via an ink jet device on an intermediate member, which dye being subsequently released and thereby transferred to a receiver sheet by combined heat and pressure. The Hirata et al. patent (U.S. Pat. No. 5,949,464) describes an ink jet ink curable by ultraviolet light for use in conjunction with an intermediate member. The Koike et al. patent (U.S. Pat. No. 5,988,790) discloses an aqueous-based ink jet ink for use with an intermediate member in a printer. The Komatsu et al. patent (U.S. Pat. No. 6,059,407) describes the use of a surfactant applied to the surface of an intermediate member employed in an ink jet recording method. The Jeanmaire et al. patent (U.S. Pat. No. 6,109,746) discloses a method of use of an intermediate member in an aqueous-based ink jet machine, which intermediate member includes cells where ink jet drops are mixed to provide a desired color in each cell, the mixed inks subsequently transferred to an image receiver. The Suzuki et al. patent (U.S. Pat. No. 6,153,001) discloses a pigmented ink including water and an aqueous organic solvent, which ink may be used with an intermediate member in an ink jet recording method.

Ink jet processes employing an intermediate member can use so-called phase change inks. The Titterington et al. patent (U.S. Pat. No. 5,372,852) describes a molten ink which solidifies on contact with a liquid layer on the surface of an intermediate member. Similarly, the Bui et al. patent (U.S. Pat. No. 5,389,958) describes a phase change ink deposited on a sacrificial liquid layer on an intermediate member. The Jones patent (U.S. Pat. No. 5,864,774) discloses a melted ink jetted to an intermediate member. The Urban et al. patent (U.S. Pat. No. 5,974,298) discloses a duplex ink jet apparatus employing phase change ink jet ink on an intermediate transfer surface. The Ochi et al. patent (U.S. Pat. No. 6,102,538) describes a phase change ink jet ink which undergoes a viscosity change when ink droplets arrive at the surface of an intermediate member. The Burr et al. patent (U.S. Pat. No. 6,113,231) describe an offset ink jet color printing method in which hot melt ink droplets harden after deposition on an intermediate member, such that different color inks are overlaid on the intermediate member and subsequently co-transferred to a final receiving medium.

In view of the fact that ink jet devices presently have much slower process speeds than electrostatographic recording devices, there is a need to simplify imaging processes that utilize electroscopic toners and developers. Attempts have been made to simplify electrophotography and thereby also overcome the above-mentioned difficulties associated with aqueous-based ink jet inks, e.g., by using novel electrographic methods for directly depositing small dry toner particles on a receiver using digital signals, without the need for a photoconductor as in electrophotography. For example, small dry toner particles are delivered directly to a receiver from a two-component developer using an integrated printhead, as disclosed in the Mey et al. patents (U.S. Pat. Nos. 5,818,476, 5,821,972 and 5,889,544) and in the Grande et al. patent (U.S. Pat. No. 6,037,957). Thermal fusing of toner particles to fix a resulting toner image to paper generally results in only minor dot spreading. Other examples are the Schmidlin patents (U.S. Pat. Nos. 5,541,716 and 5,850,587). These novel methods for utilizing dry toner particles, still in their infancy, have to date suffered from a difficulty in delivering enough toner particles through the printheads to achieve high image densities at high process speeds, and also have tended to have relatively low resolution.

A novel type of electrographic apparatus for depositing drops of nonaqueous liquid inks containing pigmented particles is disclosed in the Newcombe et al. patent (U.S. Pat. No. 5,992,756), the Taylor et al. patent (U.S. Pat. No. 6,019,455), the Lima-Marques patent (European Patent No. 0646044), the Emerton et al. patent (European Patent No. 0760746), the Newcombe et al. patents (European Patent Nos. 0885126 and 0885128), the Janse van Rensburg patent (European Patent No. 0885129), the Mace et al. patent (European Patent No. 0958141), and the Newcombe patent (European Patent No. 0973643). The nonaqueous liquid inks that are used include electrically charged pigmented particles and oppositely charged inverse micelle counterions. Ink is supplied to a writing head wherein the electroscopic pigmented particles are concentrated near an ejection location. By applying controlled voltage pulses, agglomerates or clusters of the pigmented particles are electrostatically ejected from the ejection location and travel to the surface of a receiver member. As a result of agglomeration, relatively little liquid is carried to the receiver, requiring little or no drying or removal of excess liquid from the receiver. Although a physical understanding of how the particles are concentrated has not yet been elucidated in detail, the concentrating of the pigmented particles near the ejection location (accompanied by at least a partial separation from counterions) is attributed to electrophoretic and dielectrophoretic forces. These electrophoretic and dielectrophoretic forces are induced by a number of important factors which may not as yet be optimized, including a suitable geometrical arrangement of electrodes in the writing head, suitable potentials applied to the electrodes, a suitable geometry of the ejection location, and a suitable geometry of the liquid flow channels within the head. This type of novel apparatus tends to have an inherent problem with plateout of particles, at or near the ejection location, thereby deleteriously affecting performance. There is also a problem with replenishment of non-agglomerated ink in the vicinity of a nozzle and removal of the particle-depleted carrier liquid from the vicinity of the nozzle. Another difficulty is a need for a complex writing head including a number of properly disposed electrodes and associated applied potentials. Such apparatus also has a disadvantage by comparison with conventional liquid developer electrophotography in that the associated ink technology is relatively immature. For example, specially tailored inks are needed to provide suitable agglomeration behavior in the write head. Such inks are reported to need high resistivities, higher than the resistivity of a typical electrophotographic liquid developer. Moreover, the inks require a suitable stability or keeping property for practical utility in the marketplace. Long keeping or storage time is a characteristic that was historically difficult to achieve for commercial electrophotographic liquid developers. Nonaqueous liquid inks suitable for use with a writing head of an apparatus of the above disclosures are described in the Nicholls et al. patent (U.S. Pat. No. 5,453,121) and the Nicholls patents (U.S. Pat. No. 6,117,225 and European Patent No. 0939794). Similar apparatus and types of inks are disclosed in the Kohyama patent (U.S. Pat. No. 6,126,274) for image recording, and the Kato patent (U.S. Pat. No. 6,133,341) for making lithographic printing plates. The Nicholls patent (U.S. Pat. No. 6,117,225) cited above discloses an improved ink which reduces plateout, the improved ink including marking particles covered with a highly resistive coating.

The aforementioned Kato patent (U.S. Pat. No. 6,133,341) describes the use of a head for ink jet recording including a narrow electrode mounted in a slit, such that droplets of nonaqueous ink are discharged from the discharge slit upon application of a voltage to the discharge electrode; this patent does not explicitly mention a concentrating of the pigmented particles before droplets are discharged from the head.

The above-cited Kohyama patent (U.S. Pat. No. 6,126,274) discloses the use of an intermediate image receiving member for receiving agglomerated marking particles ejected from the writing head. This intermediate image receiving member is a moving web, and a particulate image formed on this web by the writing head is transported by the web to a transfer nip where the particulate image is transferred to a receiver member. Transfer of the marking particles to the receiver may be effected thermally or electrostatically.

The use of a preferably compliant intermediate transfer member in liquid developer electrophotography is well known, e.g., see recent patents including the Gazit et al. patent (U.S. Pat. No. 5,745,829), the Fujiwara et al. patent (U.S. Pat. No. 5,745,830), the Tarnawskyj et al. patent (U.S. Pat. No. 5,761,595), the Hara et al. patent (U.S. Pat. No. 6,097,920), the Nakano et al. patent (U.S. Pat. No. 6,115,576), and the Miyamoto et al. patent (U.S. Pat. No. 6,146,804). An intermediate transfer member is of particular utility for successively receiving, from one or more photoconductive imaging members, a plurality of single color liquid developer toner images transferred in register with one another to form a plural toner image on the intermediate member, the plural or full color toner image being subsequently transferred from the intermediate member to a receiver member.

As is well known, most electrophotographic liquid developers include only a small percentage by weight of toner solids. Typically, less than about 5% by weight of a liquid developer is toner, the remainder being a carrier liquid or dispersant in which the toner particles are dispersed. The toner particles generally have diameters less than about 3 micrometers, typically 1 micrometer or less. Inasmuch as a toner particle image immediately after transfer to a receiver sheet preferably contains a minimum amount of liquid, various methods have been disclosed to remove excess carrier liquid or developer from a wet electrographic liquid toner image, the wet toner image being located on an imaging member or on an intermediate transfer member prior to removal of excess liquid.

The Landa et al. patent (U.S. Pat. No. 4,286,039) describes removal of excess developer from a photoconductor using a deformable squeegee roller biased to a voltage having a polarity of the same sign as that of the toner particles. The Moraw patent (U.S. Pat. No. 4,482,242) describes removal of excess developer from a photoconductive drum using a stripper roller rotating 20% faster than the drum. The Moe et al. patent (U.S. Pat. No. 5,754,928) and the Teschendorf et al. patents (U.S. Pat. Nos. 5,713,068, 5,781,834 and 5,805,963) describe removal of excess developer liquid using a squeegee roller. The Tagansky et al. patent (U.S. Pat. No. 5,854,960) describe removal of excess liquid from a surface, leaving a portion of the liquid for transfer to another surface. The Kellie et al. patent (U.S. Pat. No. 6,091,918) describes removal of excess developer liquid using a squeegee roller having a core with a crowned profile.

The Asada et al. patent (U.S. Pat. No. 5,765,084) describes use of squeeze rollers to remove excess developer liquid from a photoconductive member and to control the thickness of the developer liquid prior to toner transfer from the photoconductive member to an intermediate member. A full color imaging apparatus is described in which a corona charge having a polarity the same as the polarity of the charge on the toner particles is applied to a first color toner image after transfer of the first color image to the intermediate member. A similar corona charging procedure is followed after a second color toner image has been transferred in registry on top of the first color toner image, and the process repeated until a full color toner image is on the intermediate member for subsequent transfer to a receiver sheet. The corona chargings after each transfer to the intermediate member levels the surface potential and also retards back transfer of toner to the imaging member.

In the Landa et al. patent (U.S. Pat. No. 4,974,027) an apparatus for "rigidizing" a liquid developed toner image on an image bearing surface prior to transfer is described, including using a squeegee device such as a metering roller to remove excess liquid and applying an electric field between the image bearing surface and another member, e.g., a roller in close propinquity to the image bearing surface. In the Domoto et al. patent (U.S. Pat. No. 5,974,292) an apparatus including liquid development is described for metering post-development fluid laid down on an imaging belt after development of a latent image, wherein a compacting of a toner image on the imaging belt is accomplished by the application of an electric field in a direction to urge the toner particles towards the surface of the imaging belt.

In the Simms et al. patent (U.S. Pat. No. 5,332,642) a device and method are disclosed for increasing the solids content of a liquid-developed image on an absorptive image carrying member such as a primary imaging member or an intermediate transfer member. The image carrying member may be a porous roller provided with an interior vacuum mechanism for drawing carrier fluid through the absorptive material of the roller, the roller also being electrified with a polarity to repel toner particles from the absorptive or porous material so that minimal toner particles are transferred to the absorptive material. In the Moser patent (U.S. Pat. No. 5,723,251) an intermediate transfer member roller is disclosed for liquid development electrophotography which includes an absorptive layer for imbibing carrier liquid from a toner image on the intermediate transfer roller.

A contact member may be used for squeezing the imbibed liquid from the intermediate transfer roller. Alternatively, a vacuum may be used for sucking the imbibed liquid from the absorptive layer, or a heating or cooling member may be used for "sweating" liquid from the absorptive layer. In the Herman et al. patent (U.S. Pat. No. 5,965,314) an intermediate transfer member is described that contains a material which is capable of absorbing carrier liquid in amounts from 5% to 100% by weight, based on the weight of the absorbing material, after ten minutes of soaking. Suitable absorbing materials are elastomeric materials having an affinity for hydrocarbon carrier liquids, such as crosslinked isoprene, natural rubber, EPDM rubber and certain crosslinked silicone elastomers.

The Landa et al. patent (U.S. Pat. No. 4,286,039) previously cited herein above discloses the use of a blotting roller to absorb excess developer liquid from a photoconductor. The blotting roller is biased by a potential having a sign the same as a sign of the toner particles in the developer, and includes a closed-cell polyurethane foam formed with open surface pores. Devices are provided for squeezing liquid absorbed by the pores from the pores so as to continuously present open dry pores for blotting. The Landa patent (U.S. Pat. No. 4,392,742) similarly describes a blotting roller having externally exposed internally isolated surface cells. The Kurotori et al. patent (U.S. Pat. No. 4,985,733) discloses a blotting roller, a transfer sheet including a liquid developed image facing the blotting roller, and a backup roller behind the transfer sheet. The blotting roller removes excess liquid prior to fusing the image in a fusing station. The Simms et al. patent (U.S. Pat. No. 5,965,314) discloses an absorptive belt to draw off liquid toner carrier liquid from a wet image located on an image carrying member such as an electrostatographic imaging member or intermediate transfer member. The belt is semiconductive and is passed over a roller that is biased to a potential of the same polarity as that of the toner particles. Fluid is removed from the belt by a squeegee roller. The Larson et al. patent (U.S. Pat. No. 5,839,037) discloses a multicolor imaging electrostatographic apparatus including a photoconductive imaging belt passing through a plurality of color stations wherein each color station forms a different color liquid developed toner image on the belt, each successive image being formed in registry on top of the priorly formed toner images. After an individual color toner images has been developed on the belt, an absorptive blotter roller biased to a potential having the same sign as the respective toner particles is used to absorb carrier fluid. The roller is porous and has a central chamber connected to a vacuum for removing liquid continuously. When a full color image has been formed on the imaging belt, it is transferred to a second belt. The full color image is then transported to come into contact with an absorptive belt for removing additional carrier fluid, after which the full color toner image is heated, thereby forming two phases including a toner-rich phase and a nearly pure carrier phase. The heated full color toner image is then transferred to a receiver under transfix conditions, i.e., without the need for an electric field. The Lewis patent (U.S. Pat. No. 5,987,284) discloses a xerographic method and apparatus for conditioning a liquid developed image. A metering roller is used to remove excess carrier liquid from a liquid developed toner image, and subsequently an electrically biased roller is used to electrostatically compress the toner image, e.g., on an imaging member or on an intermediate transfer member. The roller is porous and includes a central chamber connected to a vacuum for removing carrier liquid continuously. The Seong-soo Shin et al. patent (U.S. Pat. No. 6,085,055) discloses an external blotter roller for removing excess carrier liquid from a liquid developed electrophotographic image formed on a photoconductive belt. Liquid is thermally removed from the roller by evaporation, the roller being contacted and heated by heating rollers. The vapors are condensed to liquid which is collected.

Dispersions such as liquid developers for use in electrophotography and nonaqueous inks for use in ink jet recording have in common the use of an organic carrier fluid, typically a hydrocarbon. In particular, mixed alkanes commercially marketed by the Exxon Corporation under the trade name, Isopar, are useful. Various Isopars having different flash points and evaporation rates are available. Liquid developers made with Isopars having flash points greater than 140° F., e.g., Isopar L and Isopar M, have been disclosed in the Santilli et al. patent (U.S. Pat. No. 5,176,980). Nonaqueous inks including Isopars are disclosed by the Nicholls patent (European Patent No. 0939794), the Nicholls at al. patent (U.S. Pat. No. 5,453,121), the Kohyama patent (U.S. Pat. No. 6,126,274) and the Kato patent (U.S. Pat. No. 6,133,341), cited above.

There remains a need for a simplified, non-electrostatographic method for forming high resolution color images, which simplified method does not include any electrostatic latent image, nor development of any latent image by an electroscopic toner, nor a first transfer of any developed electroscopic toner image to an intermediate transfer member for a subsequent second transfer to a receiver member. In particular, there remains a need to provide better reliability and a higher resolution than can be readily obtained from novel methods of direct deposition of dry toner particles, such as disclosed in U.S. Pat. Nos. 5,541,716, 5,818,476, 5,821,972, 5,850,587, 5,889,544, and 6,037,957, cited herein above. Furthermore, there remains a need to circumvent problems associated with apparatus such as described for example in above-cited U.S. Pat. Nos. 5,992,756, 6,019,455, 6,126,274 and 6,133,341 in which a pigmented ink is concentrated in an ink jet write head so as to eject agglomerates of toner particles, the main problems including plateout of ink particles in the write head, ink replenishment and liquid flow problems in the write head, and the need for a complicated electrode configuration in the writehead.

SUMMARY OF THE INVENTION

The invention provides an imaging method and apparatus including: an ink jet device utilizing an ink containing colloidally dispersed particles, an intermediate member having an operational surface upon which a primary ink jet image is formed from ink droplets produced by the ink jet device, an image-concentrating mechanism for causing the particles in the primary ink jet image to move into proximity with the operational surface to form a concentrated particulate image, a liquid removing mechanism for removing excess liquid from the concentrated particulate image to form a liquid-depleted particulate image or "dried" image, a transfer mechanism for transferring the liquid-depleted particulate image to a receiver member, and a regeneration device for regenerating the operational surface prior to forming a new primary image thereon. The ink includes aqueous and nonaqueous dispersions.

In one aspect of the invention, the image-concentrating mechanism provides a field which acts within the liquid of the primary ink jet image to urge individual pigmented particles to migrate towards the operational surface of the intermediate member, thereby producing a concentrated particulate image. This aspect of the invention includes embodiments utilizing a corona charger to apply a corona charge to a nonaqueous primary ink jet image to produce an electric field. Other electric field embodiments utilize a non-contacting biased electrode facing the operational surface to urge particles of the ink to migrate to the operational surface of the intermediate member. Alternatively, a contacting electrode device such as an electrically biased roller in contact with the primary ink jet image may be used to produce a concentrated particulate image. As another alternative, a magnetic field may be used to urge particles of the ink to migrate.

In yet another aspect of the invention, the image-concentrating mechanism and the liquid removal mechanism are combined such that a liquid-depleted particulate image or "dried" image is formed in one step from the primary ink jet image. In one embodiment, the liquid is evaporated from the primary ink jet image. In an alternative embodiment, the liquid is drawn into the interior of the intermediate member, or alternatively is blotted by the intermediate member. In another alternative embodiment, an external blotting member such as an electrically biased roller or web in contact with the primary ink jet image may be used to produce a liquid-depleted particulate image.

In certain embodiments of the invention in which the ink is a nonaqueous dispersion, the dispersion is of a type similar to an electroscopic liquid developer such as used in electrostatography. In such embodiments, the liquid removal mechanism can be similar to any known mechanism for removing a carrier liquid from a liquid-developed toner image situated on an electrostatographic primary imaging member or on an electrostatographic intermediate transfer member.

In certain of the embodiments, the intermediate member includes an electrode located beneath a surface layer of the intermediate member, such that the electrode is grounded or otherwise biasable by connecting it to a source of voltage. In alternative embodiments, this electrode is not planar and has a hill-and-valley shape.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

The invention provides an improved method and apparatus for digital ink jet imaging using an ink containing colloidally dispersed particles, preferably pigmented particles, in a carrier liquid. An ink jet device produces ink droplets according to a known manner for deposition on to an intermediate member, which intermediate member has an operational surface upon which a primary ink jet image is formed by the ink jet device. An image-concentrating mechanism causes the particles in the primary ink jet image to be moved into proximity with the operational surface to form a concentrated particulate image. A liquid removing mechanism for removing excess liquid from the concentrated particulate image causes a liquid-depleted concentrated particulate image to be formed. Finally, a transfer mechanism is provided for transferring the liquid-depleted particulate image from the intermediate member to a receiver member, and a regeneration mechanism is subsequently employed to regenerate the operational surface of the intermediate member prior to forming a new primary image thereon. The ink includes aqueous and nonaqueous dispersions.

Figures 1A, 1B, 1C:
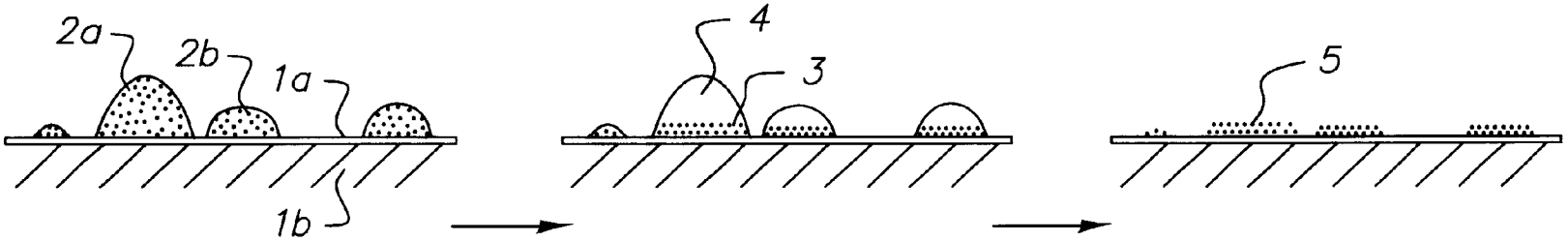
FIGS. 1*a*, 1*b*, and 1*c* schematically depicts certain process steps for practicing the invention according to an aspect of the invention.

Referring now to the accompanying drawings, FIGS. 1*a,b,c* schematically shows progression from a primary ink jet image to a liquid-depleted particulate image according to an aspect of the invention. FIG. 1*a* is a sketch of a portion of a digitally formed primary image having a gray scale, in which individual imaging pixels are shown to contain variable quantities of an ink jet liquid ink deposited as a colloidal dispersion on an operational surface, indicated by the numeral 1, of an intermediate member, 1*b*. As is well known, such a variation in the amount of liquid can be produced by an imagewise delivery of multiple ink droplets per pixel. For example, an as-deposited liquid ink amount labeled 2*a* is formed by a larger number of droplets than an amount labeled 2*b* on an adjacent pixel. To produce a gray scale, an imaging pixel of the primary image may have zero ink deposited, or a pixel may contain a plurality of droplets, e.g., as many as twenty or more droplets per pixel to achieve maximum image density, as is known in the art. As is also well known, ink jet ink droplets having a variable size may be created by an ink jet device, thereby providing an alternate way of creating a gray scale. FIG. 1*b* illustrates schematically the result of forming the concentrated particulate image from the primary image, and shows a concentrated zone or layer 3 of pigmented particles in proximity to, and preferably adhering to, the operational surface 1. A particulate-depleted liquid 4 is shown above layer 3. Liquid 4 is primarily carrier liquid of the original ink. Preferably, liquid 4 contains a negligible number of particles remaining from the original ink composition, and preferably the zone or layer 3 is compact enough to retain little or none of the carrier liquid. The concentrated particulate image of FIG. 1*b* may hereinafter be referred to as a concentrated "wet" image. FIG. 1*c* shows a sketch of the liquid-depleted concentrated image after liquid 4 of FIG. 1*b* has been removed, which liquid 4 is excess liquid. The liquid-depleted image of FIG. 1*c* may hereinafter be referred to as a "dried" image. FIG. 1*c* shows no residual liquid in the "dried" image. In general, however, a portion, preferably a major portion, of the liquid of the concentrated particulate image is removed to form a liquid-depleted image, which liquid-depleted image can in certain cases retain a significant amount of residual liquid. Although for simplicity of exposition only three thicknesses of liquid-depleted material are illustrated in FIG. 1*c*, it will be henceforth understood in the described embodiments that in order to produce high quality imaging there will be many density level differences between Dmin and Dmax, with pixels containing corresponding thicknesses of marking material to create these density level differences. Descriptions of how a concentrated image and a liquid-depleted image may be formed and transferred to a receiver are given below.

Figure 2:
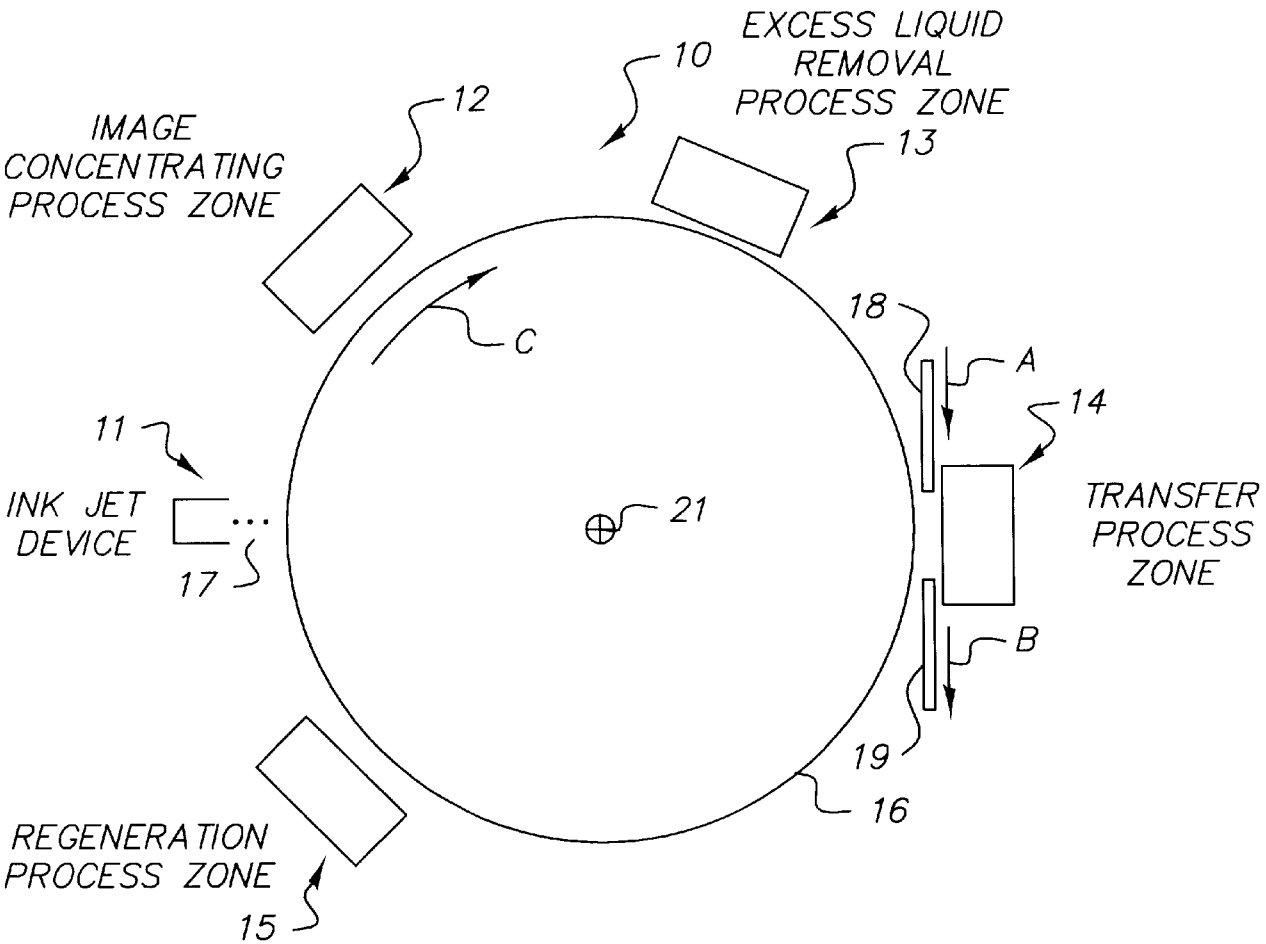
FIG. 2 is a schematic side elevational view of a generic embodiment of an apparatus of the invention showing both specific and generalized components thereof.

FIG. 2 shows a preferred embodiment of an ink jet imaging apparatus for creating gray scale images according to the invention. The imaging apparatus, designated generally by the numeral 10, includes: an ink jet device 11 for depositing ink droplets 17 to form a primary ink jet image on the operational surface of an intermediate member 16 mounted on shaft 21 rotating in a direction of an arrow labeled C, an Image Concentrating Process Zone 12 for forming a concentrated image, an Excess Liquid removal Process Zone 13 for forming a liquid-depleted image, a Transfer Process Zone 14 for transferring the liquid-depleted image from intermediate member 16 to a receiver member, and a Regeneration Process Zone 15 for preparing the intermediate member for a fresh primary image. A receiver sheet 18, moving in a direction of arrow A, is shown approaching Transfer Process Zone 14. A receiver sheet 19 is shown leaving the Transfer Process Zone in a direction of arrow B. Receiver 19 carries a liquid-depleted material image derived from a primary ink jet image previously formed by ink jet device 11 on intermediate member 16, which liquid-depleted material image is transferred in Process Zone 14 from intermediate member 16 to receiver, e.g., receiver 19. Intermediate member 16 may be rotated by a motor drive applied to shaft 21, or alternatively by a frictional drive produced by a frictional engagement with another rotating member (not shown).

In an alternate embodiment, intermediate member 16 may be in the form of an endless web onto which is deposited a primary ink jet image by ink jet device 11, which web is driven or transported past or through the various Process Zones 12, 13, 14 and 15. The liquid-depleted material image is transferred from the web to a receiver member in Transfer Process Zone 14.

Image Concentrating Process Zone 12, Excess Liquid removal Process Zone 13, Transfer Process Zone 14 and Regeneration Process Zone 15 may include the use of rotatable elements. The rotatable elements of the subject invention are shown as both rollers and webs in the examples of this description but may also include drums, wheels, rings, cylinders, belts, loops, segmented platens, platen-like surfaces, and receiver members which receiver members include receiver members moving through nips or adhered to drums or transport belts.

Although Image Concentrating Process Zone 12, Excess Liquid removal Process Zone 13, Transfer Process Zone 14 and Regeneration Process Zone 15 are shown as discrete zones in FIG. 2, in certain embodiments there may not be a distinct separation of zones, i.e., there may be a physical or functional overlapping of zones as will be clarified below.

The ink jet device 11 may include any known apparatus for jetting droplets of a liquid ink in a controlled imagewise fashion on to the operational surface of intermediate member (IM) 16, with digital electronic signals controlling in known manner a variable number of droplets delivered to each imaging pixel on the operational surface. A primary image made on the operational surface by the liquid ink droplets may be a continuous tone image, or it may be a half-tone image including gray-level half-tones, frequency modulated half-tones, area-modulated half-tones and binary halftones as are well known in the art. It should be understood that the conventional and well-known terms "continuous tone" and "half-tone" refer not only to any place-to-place variations of the quantity of ink within the image on the operational surface, but also to any corresponding color or density that may subsequently be produced or induced in imagewise fashion by these same variations of the quantity of ink. The operational surface includes any portion of the surface of the intermediate member 16 upon which a primary ink jet image may be formed by ink jet device 11. An imaging pixel is defined in terms of the image resolution, such that if the resolution were, say, 400 dots per inch (dpi), then a square pixel for example would occupy an area on the operational surface having dimensions of 63.5 $\mu$m×63.5 $\mu$m. Thus, an imaging pixel is a smallest resolved imaging area in a primary image. The ink jet device 11 includes a continuous ink jet printer or a drop-on-demand ink jet printer including a thermal type of ink jet printer, a bubble-jet type of ink jet printer, and a piezoelectric type of ink jet printer. A drop-on-demand ink jet printer is preferred. Ink jet device 11 typically has a writehead (not shown) which includes a plurality of electronically controlled individually addressable jets, which plurality may be disposed in a full-width array, i.e., along the operational width of intermediate member 16 in a direction parallel to the axis of shaft 21. Alternatively, as is well known, the writehead may include a relatively smaller array of jets and the writehead is translated back and forth in directions parallel to the axis of shaft 21 as the operational surface of intermediate member 16 rotates. The ink used by the ink jet device 11 is provided from a reservoir (not shown) and it is preferred that the composition of the ink droplets 17 be substantially the same as the composition of the ink in the reservoir. The ink jet head preferably produces a negligible segregation of components of the ink, i.e., certain components are not intentionally preferentially retained by the writehead and certain other components are not intentionally preferentially jetted in the droplets 17. More specifically, it is preferred that no applied fields are used in the writehead, e.g., such as when using a colloidal particulate ink so as to increase the number of particles per unit volume in the jetted droplets 17 to a value higher than the number of particles per unit volume within the reservoir.

An ink used to form droplets 17 includes nonaqueous and aqueous-based inks, which inks are colloidal dispersions of particles in a carrier liquid or fluid. Preferably, the particles are pigmented particles, and more preferably, solid pigmented particles. However, particles which are not colored may be used, including solid or liquid particles containing precursor chemicals that may be subsequently transformed, by any suitable chemical or physical process, into a material image having any useful property, composition, or color, e.g., transformed when an ink-jet-ink-derived image is located either on intermediate member 16 or on a receiver, e.g., receiver 19. The carrier fluid of an aqueous-based ink dispersion may contain a proportion, typically a minor proportion, of any suitable miscible nonaqueous solvent. A volume percentage of dispersed particulates in a colloidal ink useful in the invention may have any suitable value, typically between about 3% and 50%. A nonaqueous colloidal ink dispersion is generally preferred. However, an aqueous-based colloidal ink dispersion may be useful in certain embodiments. Formulations similar to, or identical with, commercially available (nonaqueous) electrophotographic liquid developers may be used as inks for practicing the invention. Formulations similar to, or identical with, commercially available pigmented ink jet inks, including both nonaqueous and aqueous-based ink jet inks, may also be used for practicing the invention. Inks useful for the invention may be sterically stabilized, electrostatically stabilized such as a typical aqueous-based ink dispersion, or may include both steric and electrostatic stabilization, such as a typical electrophotographic liquid developer. Methods and materials for stabilization of both nonaqueous and aqueous dispersions are well known (see for example references cited above, in the section describing the background of the invention). For nonaqueous inks useful in the invention, it is preferred that the particles are both sterically and electrostatically stabilized, i.e., the particles preferably carry an electrostatic charge with counterions present in the surrounding carrier fluid providing overall electrical neutrality. The particle sizes or particle size distributions of the particles used in a colloidal ink for practicing the invention are similar to the particle sizes or particle size distributions of the particles used in colloidal particulate dispersions including commercial electrophotographic liquid developers and commercial ink jet inks. Particulate ink dispersions useful for practice of the invention may be made by any known method, including grinding methods, precipitation methods, spray drying methods, limited coalescence methods, and so forth. Particulate ink dispersions useful for practice of the invention may be formulated in any known way, such as by including dispersal agents, stabilizing agents, drying agents, glossing agents, and so forth. Pigmented particles used in ink dispersions of the invention may include one or more pigments, plus suitable binders for the pigments. A binder is typically made of one or more synthetic polymeric materials, which polymeric materials are selected to have good fusing properties for fusing a pigmented particulate image to a receiver for creating an output print, as described more fully below. The pigments are preferably commercially available pigments and may be crystalline or amorphous. Typically, a pigment is comminuted to very small sizes, e.g., sub-nanometer sizes, and dispersed substantially uniformly in the binder by known methods. It is preferred that pigments and binders used to make inks for the invention are substantially insoluble in the carrier liquid of the dispersion. For nonaqueous inks, it is preferred to use one or more hydrocarbon alkanes for the primary component of the carrier liquid, although any suitable high resistivity or insulating nonaqueous liquid may be used. Particularly useful are mixtures of alkanes marketed by Exxon under the tradename Isopar, and various Isopars are available. Preferred Isopars are those having a flash point of 140° F. and above, such as Isopar L and Isopar M. However, other, lower molecular weight Isopars, such as Isopar G, may be used. It is also preferred to employ a precursor dispersion that may be manufactured as a concentrate having a high volume percentage of particulates, which concentrate is diluted with carrier fluid to form a resulting ink prior to introducing the ink into the reservoir of the ink jet device 11.

In order to inhibit sticking of particles of a colloidal ink dispersion to any interior walls or surfaces of the writehead of ink jet device 11, including the interiors of the jets, it is preferred that the surface characteristics of the interior walls or surfaces be such that particles in the dispersion are repelled by the interior walls or surfaces, and also preferably that the carrier liquid of the ink does not wet the interior walls or surfaces. For example, when using a nonaqueous hydrophobic ink, it is preferable to provide hydrophilic interior walls or surfaces. Similarly, when using an aqueous-based hydrophilic ink, it is preferable to provide hydrophobic interior walls or surfaces. Also, it is preferred that ink particles include sterically stabilizing polymeric moieties adsorbed on their surfaces, which moieties inhibit close approach of the particles to the interior walls or surfaces.

In the Excess Liquid Removal Process Zone 13, excess liquid is removed from the concentrated image formed in the Image Concentrating Process Zone 12. In general, a portion, preferably a major portion, of the liquid is removed from the concentrated image so as to form a liquid-depleted image, which liquid-depleted image can in certain cases retain a significant amount of residual liquid. In certain circumstances substantially all of the liquid may be removed to form the liquid-depleted image. Image Concentration Process Zone 12 includes an image concentrating device which includes one of the following devices: a corona charging device, a biased contacting electrode device, a biased non-contacting electrode device, and a magnetic field device. These image concentrating devices are described more fully below. Any other suitable image concentrating device or process may be used.

Excess Liquid Removal Process Zone 13 includes an excess liquid removal device which is any of the following known devices: a squeegee (roller or blade), an external blotter device, a heating device, a skiving device, and an air knife device. These excess liquid removal devices are described more fully below. Any other suitable excess liquid removal device or process may be used.

Transfer Process Zone 14 for transferring an ink-jet-ink-derived material image from intermediate member (IM) 16 to a receiver member includes any known transfer device, e.g., an electrostatic transfer device, a thermal transfer device, and a pressure transfer device. As is well known, both an electrostatic transfer device and a thermal transfer device can be used with an externally applied pressure. An electrostatic transfer device for use in Transfer Process Zone 14 typically includes a backup roller (not shown), which backup roller is electrically biased by a power supply (not shown). The backup roller co-rotates in a pressure nip relationship with intermediate member 16, and a receiver member such as sheet 18 is translated through the nip formed between the backup roller and intermediate member 16. An ink-jet-ink-derived material image carrying an electrostatic net charge is transferable by an electrostatic transfer device from intermediate member 16 to the receiver, i.e., an electric field is provided between intermediate member 16 and the backup roller to urge transfer of the ink-jet-ink-derived material image. For use to augment electrostatic transfer when an ink-jet-ink-derived material image on intermediate member 16 has a low electrostatic charge or is uncharged, a charging device (not shown) such as for example a corona charger or a roller charger or any other suitable charging device may be located between Excess Liquid Removal Process Zone 13 and Transfer Process Zone 14, which charging device may be used to suitably charge the ink-jet-ink-derived liquid-depleted material image prior to subsequent electrostatic transfer of the material image in Transfer Process Zone 14. Alternatively, a thermal transfer device may be used to transfer the ink-jet-ink-derived material image, which thermal transfer device can include a heated backup roller (not shown), which backup roller is heated by an external heat source such as a source of radiant heat or by a heated roller (not shown) contacting the backup roller (not shown). Alternatively, the backup roller for thermal transfer can be heated by an internal source of heat. The backup roller for thermal transfer co-rotates in a pressure nip relationship with intermediate member 16, and a receiver member such as sheet 18 is translated through the nip formed between the heated backup roller and intermediate member 16. In certain embodiments, intermediate member 16 may be similarly heated, either from an internal or external source of heat. As an alternative, a thermal Transfer Process Zone 14 may include a transfusing device, wherein an ink-jet-ink-derived material image is thermally transferred to and simultaneously fused to a receiver. As yet another alternative, a pressure transfer device may be used in Transfer Process Zone 14 to transfer an ink-jet-ink-derived material image, which pressure transfer device includes a backup pressure roller (not shown) which pressure roller co-rotates in a pressure nip relationship with intermediate member 16, and a receiver member such as sheet 18 is translated through the nip formed between the pressure backup roller and intermediate member 16. In such a pressure transfer device, an adhesion of the ink-jet-ink-derived material image is preferably much greater on the surface of the receiver than on the operational surface of intermediate member 16, and preferably the adhesion to the operational surface of intermediate member 16 is negligible.

As an alternative to the use of receiver sheets such as sheets 18,19 in the Transfer Process Zone of any of the above-described embodiments, a receiver in the form of a continuous web (not illustrated) may be used in Transfer Process Zone 14, which web passes through a pressure nip formed between intermediate member 16 and a transfer backup roller (not illustrated). A receiver in the form of a continuous web may be made of paper or any other suitable material.

In other alternative embodiments, a transport web (not illustrated) to which receiver sheets are adhered may be used in Transfer Process Zone 14 to transport receiver sheets through a pressure nip formed between intermediate member 16 and a transfer backup roller (not illustrated).

A receiver, for example receiver 19, which has passed through Transfer Process Zone 14 may be moved in the direction of arrow B to a fusing station (not shown in FIG. 2).

Apparatus 10 may be included as a color module in a full color ink jet imaging machine. A receiver such as receiver 19, which has received an ink-jet-ink-derived material image of a particular color from intermediate member 16, may be transported to another apparatus or module entirely similar to apparatus 10, wherein an ink-jet-ink-derived material image of a different color may be transferred from a similar intermediate member in a similar Transfer Process Zone, which different color image is transferred atop and in registration with the ink-jet-ink-derived material image transferred to the receiver in apparatus 10. In a set of such similar modules arranged in tandem, ink-jet-ink-derived material images forming a complete color set may be successively transferred in registry one atop the other, thereby creating a full color material image on a receiver. The resulting full color material image may then be transported to a fusing station wherein the material image is fused to the receiver.

The operational surface of intermediate member 16, after leaving the Transfer Process Zone 14, is rotated to a Regeneration Process Zone 15 where the operational surface is prepared for a new primary image to be subsequently formed by ink jet device 11. In one embodiment, the Regeneration Process Zone is a cleaning process zone wherein residual material of the liquid-depleted material image is substantially removed using known devices or methods, including use of a cleaning blade (not shown) or a squeegee (not shown) to scrape the operational surface substantially clean. Alternatively, a cleaning roller (not shown) is provided to which residual material of the liquid-depleted material image adheres, thereby producing a substantially clean operational surface in Regeneration Process Zone 15. Any other known suitable cleaning mechanisms may be used, including brushes, wipers, solvent applicators, and so forth (not shown).

In an alternative embodiment including a Regeneration Process Zone 15, any residual carrier liquid that might still be retained by intermediate member 16 after leaving the Transfer Process Zone 14 is removed in conjunction with, or in tandem with, removal of any unwanted solids, such as for example using a squeegee (not shown). Alternatively, a relatively hard squeeze roller (not shown) may be used for squeezing excess liquid out of intermediate member 16, which squeezed out liquid may be collected and recycled. For removing relatively small amounts of residual liquid, a source of heat can be provided in Process Zone 15 to suitably cause evaporation of any residual carrier liquid (which resulting vapor may be condensed and recycled). The source of heat (not illustrated), may be internal to intermediate member 16 or may be externally provided, such as for example by a heated roller (not shown) or by a radiant energy source (not shown). Alternatively, residual liquid may be absorbed in Process Zone 15 by an external blotter (not shown), which blotter being for example in the form of a roller or a web contacting the operational surface of intermediate member 16. As another alternative, a vacuum device (not shown) may be used to suck up and possibly recycle any residual liquid from the operational surface of intermediate member 16. As yet another alternative, a vacuum device (not shown) may be used to suck residual liquid through a porous surface layer or layers (not shown in FIG. 3) into an interior chamber of intermediate member 16, which residual liquid is carried out of the interior chamber (for possible recycling) through any suitable vent, e.g., through a hollow shaft 21 having the form of a pipe connecting the vacuum device to the interior chamber.

Figure 3:
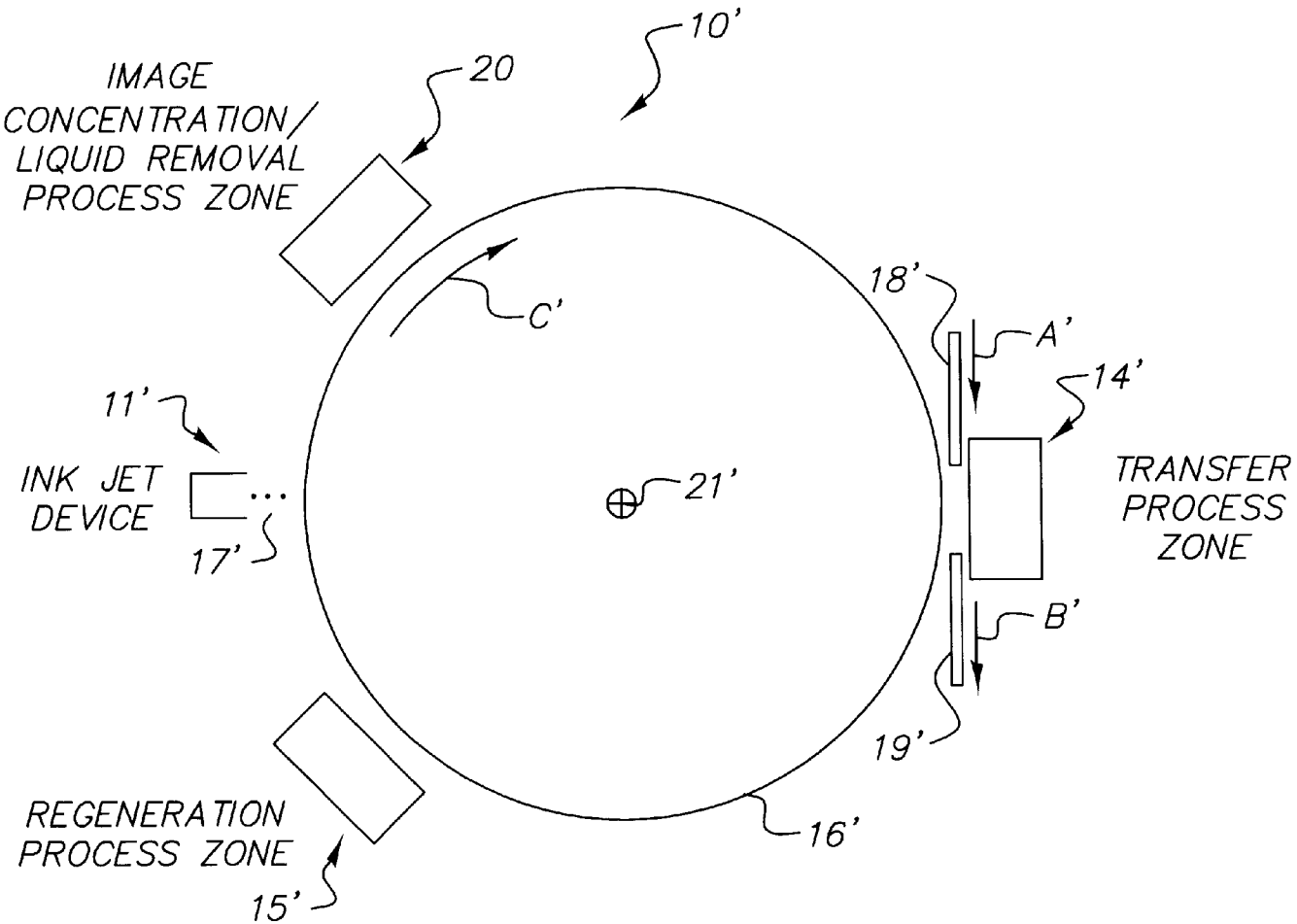
FIG. 3 is a schematic side elevational view of an alternative generic embodiment of the apparatus of the invention shown in FIG. 2.

Turning now to an alternative embodiment of FIG. 3, an apparatus 10' for creating gray scale images according to the invention is depicted which is similar to apparatus 10 except that this alternative embodiment has an Image Concentration/Liquid Removal Process Zone 20 which combines the functions of the separate Image Concentration Process Zone 12 and Excess Liquid Removal Process Zone 13 of apparatus 10. It will be made clearer below that the "Image Concentration/Liquid Removal Process Zone" 20 may not only a include a specific piece of apparatus, but also a zone of combined action of any image concentrating or liquid removal process or processes taking place in a time interval, between the time of formation of the primary ink jet image on intermediate member 16' and the time of transfer to a receiver of the corresponding ink-jet-ink-derived material image in Transfer Process Zone 14'. In FIG. 3, primed (') entities are in all respects similar to the corresponding unprimed entities in FIG. 2. In further disclosure below, embodiments including an Image Concentration/Liquid Removal Process Zone 20 are described.

Figure 4:
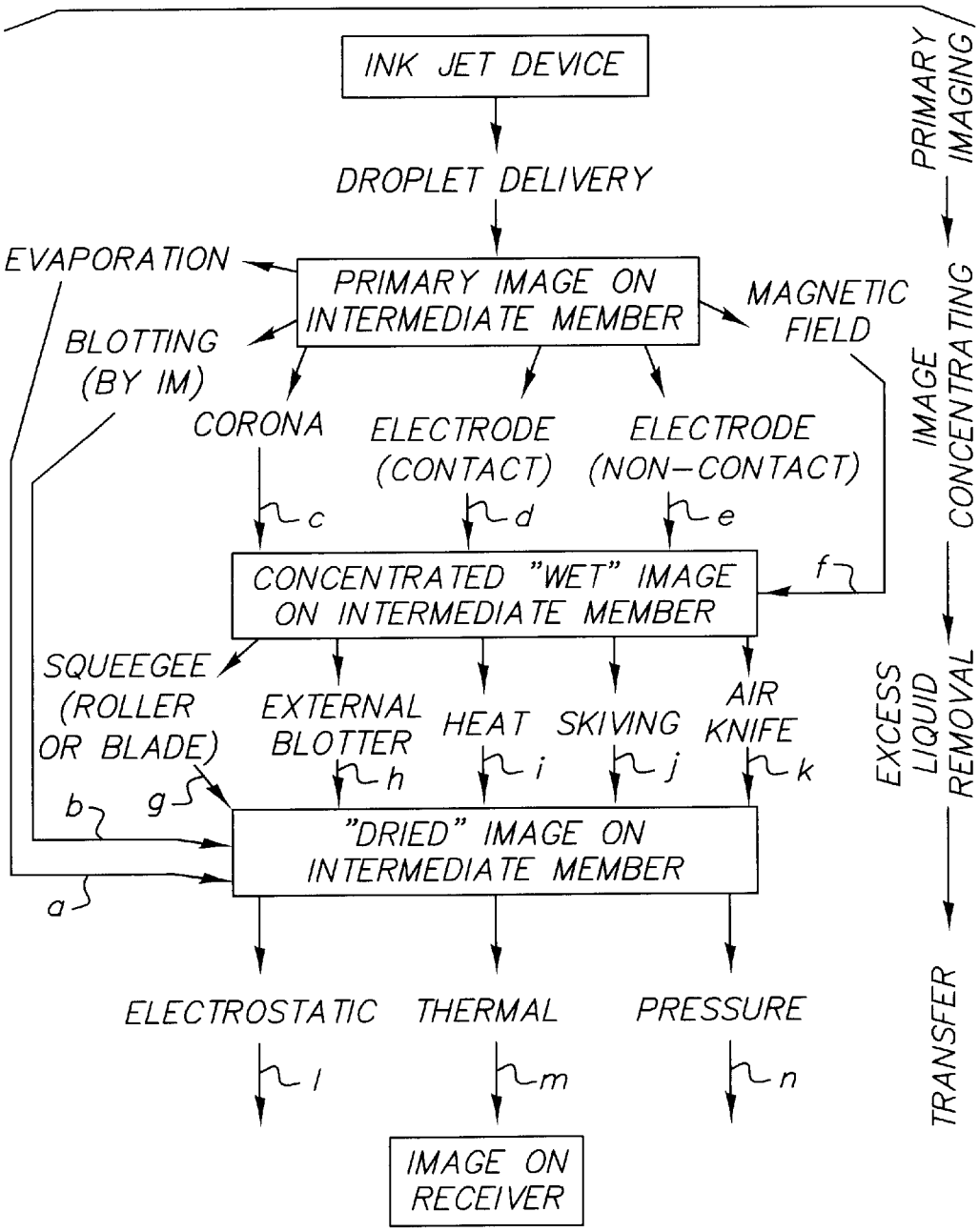
FIG. 4 is a flow chart illustrating various pathways of steps for practicing the invention.

FIG. 4 is a flow chart, relating to portions of FIGS. 2 and 3, the flow chart showing in abbreviated fashion various sets of steps for practicing the invention. Thus, starting at the top right of FIG. 4, the right hand column indicates passage from the ink jet device 11 through successive Process Zones 12, 13 and 14, or from the ink jet device 11' through successive Process Zones 20 and 14', i.e., to successively produce primary imaging, image concentrating, excess liquid removal, and transfer. According to the invention, after a primary image is formed on the intermediate member (IM) 16 or 16', there are various possible routes to reach the condition of a liquid-depleted or "dried" image described herein above with reference to FIG. 1. Arrows labeled as a and b refer to FIG. 3, whilst the remainder of the arrows labeled as c, d, . . . , j, k refer to FIG. 2. The arrows labeled c, d, e, and f indicate at least four different routes for forming, from the primary image on the IM, a concentrated or "wet" image on the IM, and any other suitable routes may be used. Arrows labeled g, h, i, j, and k indicate at least five different routes for forming, from the concentrated image on the IM, a liquid-depleted or "dried" image on the IM, and any other suitable routes may be used. Following formation of the "dried" image, the transfer routes for transfer to a receiver as described in detail above are symbolized by the three arrows labeled as l, m, and n, i.e., representing respectively electrostatic, thermal and pressure transfer (combinations of electrostatic, thermal and pressure mechanisms for transfer are implicitly included also). With reference to FIG. 3, FIG. 4 shows possible routes from a primary image on an IM to an ink-jet-ink-derived material image on a receiver member, any one of which routes can be represented in brief as follows:

[(a, b); (l, m, n)]

where it is to be understood that at least 2×3=6 possible routes are contemplated, i.e., [a; l], [a; m], [a; n], [b; l], [b; m], or [b; n]. Similarly, with reference to FIG. 2, FIG. 4 shows other possible routes from a primary image on an IM to an ink jet derived material image on a receiver member, any one of which other routes can be represented in brief as follows:

[(c, d, e, f); (g, h, i, j, k); (l, m, n)]

where it is to be understood that at least 4×5×3=60 other possible routes are contemplated, e.g., [c; g; l], [c; g; m], . . . , and so forth, for a total of 6+66=66 routes altogether. It will be understood that the invention is not limited to the various steps depicted schematically in FIG. 4, and that any set of process steps or mechanisms that produces, from a primary ink jet image on an IM, a liquid-depleted concentrated image on the IM for transfer to a receiver, is included in the invention. Any combination of two or more of such process steps may be used in conjunction or at the same time.

The various individual processes indicated by the arrows in the flow chart of FIG. 4 will now be briefly described in relation to any relevant mechanisms for use in Process Zones 12, 13 and 14.

With reference to the Image Concentration/Liquid Removal Process Zone shown generically as 20 in FIG. 3, the primary image may be concentrated and the excess liquid simultaneously removed by an evaporation mechanism, as indicated by the arrow, a, in FIG. 4. It will be apparent below that in certain circumstances, Process Zone 20 may not in fact have a localized existence as such, nor be included in a device. For example, an evaporation of excess liquid may be accomplished by heating, such as by providing as the evaporation mechanism an internal source of heat within the intermediate member (e.g., located within intermediate member 16' and not illustrated), and it is clear that such an internal heating may obviate the need for an actual device or piece of apparatus situated between ink jet device 11' and Transfer Process Zone 14'. What is meant in this case by an "Image Concentration/Liquid Removal Process Zone" is that an action or process producing evaporation takes place in a zone between the ink jet device 11' and the Transfer Process Zone 14'. Thus, for usage herein, an "Image Concentration/Liquid Removal Process Zone" may or may not require an actual piece of apparatus situated between ink jet device 11' and Transfer Process Zone 14'. As an alternative evaporation mechanism, the intermediate member (e.g., intermediate member 16') may be heated by contact with a heated external member (not illustrated) such as a heating roller. As another alternative evaporation mechanism, evaporative heating in an Image Concentration/Liquid Removal Process Zone 20 may include a source of radiation absorbable by the intermediate member (e.g., intermediate member 16'), absorbable by any component of the ink of the primary image, or absorbable by both. The external source of radiation includes, but is not limited to: a heated body in non-contacting proximity to the primary image, a lamp, and a laser. As yet another alternative evaporation mechanism, evaporation may be produced by an airflow, which airflow is provided, e.g., by a fan (not illustrated) or by a non-contacting vacuum device (not illustrated) located in the vicinity of the primary image, or preferably by a combination of heating and airflow. Preferably the airflow does not blur the primary image prior to or during the evaporation process.

The primary image may be concentrated and the excess liquid simultaneously removed in the Image Concentration/Liquid Removal Process Zone 20 by a blotting or an absorption of the excess liquid within the intermediate member (IM) 16', as indicated by the arrow, b, in FIG. 4. A vacuum device (not shown) may be used to suck the liquid component of the primary image through a porous surface layer or layers into an interior chamber of intermediate member 16', which liquid component is carried out of the interior chamber (for possible recycling) through any suitable vent, e.g., through a hollow shaft 21' having the form of a pipe connecting the vacuum device to the interior chamber. Alternatively, intermediate member 16' may include a surface layer (not shown in FIG. 3) (or layers) that absorbs a large fraction, preferably substantially all, of the liquid component of the primary ink jet image. The absorbed liquid component is then removed from intermediate member 16' in Regeneration Process Zone 15' by mechanisms as described above.

Figure 5A:
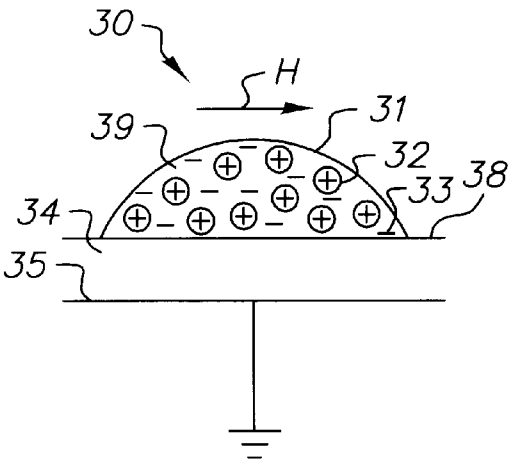
FIGS. 5*a* and 5*b* schematically illustrate the effects of a corona charging of a primary ink jet image formed from a nonaqueous ink jet ink on an intermediate member.
Figure 5B:
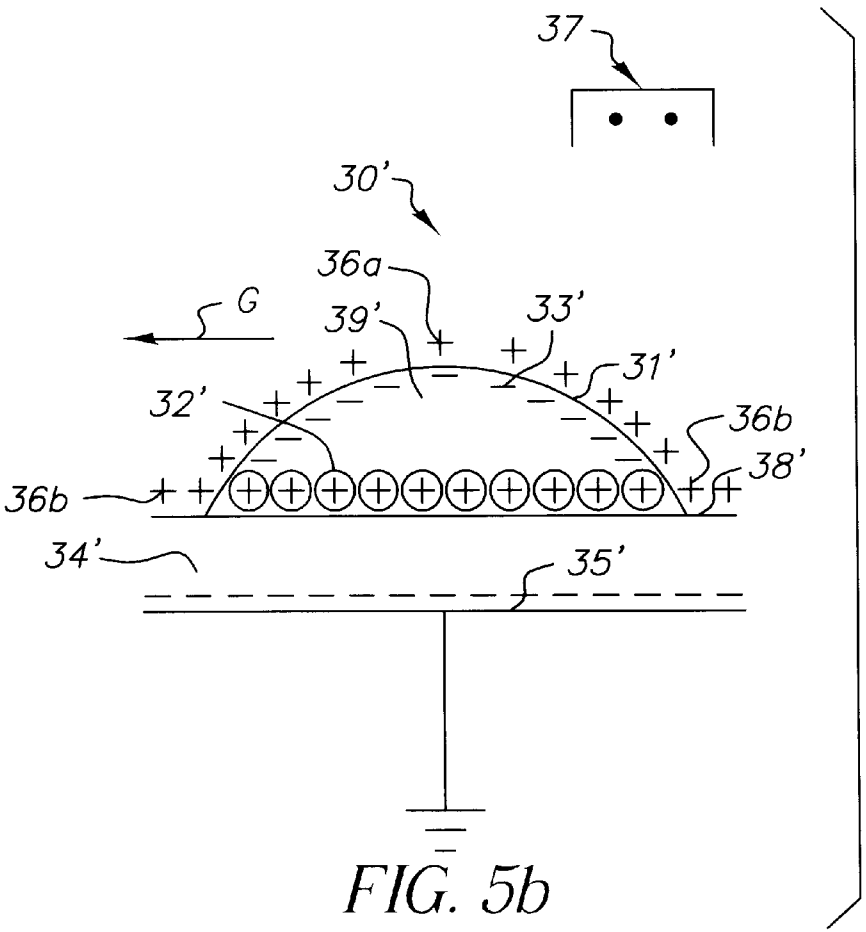

Returning to FIG. 2, a preferred embodiment having an Image Concentration Process Zone shown generically as 12 includes a corona charging device for concentrating the primary image. Use of such a device is indicated by arrow, c, in the flow diagram of FIG. 4. A corona charging device is especially useful for concentrating a primary ink jet image made from a nonaqueous ink containing charged particles. As shown in schematic side view in FIG. 5*a*, a single pixel 30 contains a drop 31 formed by a coalescence of one or more nonaqueous ink jet ink droplets deposited by an ink jet device such as device 11 on an operational surface 38, e.g., of intermediate member 16. Charged particles 32 which may have positive or negative polarity (here shown as positive) and oppositely charged counterions or micelles 33 are shown coexisting as a colloidal dispersion in an insulating carrier liquid 39. Drop 31 rests on an outer layer or layers 34 of an intermediate member, e.g., of intermediate member 16. Layer 34 is preferred to be electrically insulating and is adhered to a grounded electrode 35, which electrode may be the surface of a metallic drum, e.g., made of aluminum or other suitable metal, on which layer 34 is formed or coated. As an alternative, electrode 35 can be a thin conductive layer, e.g., made of nickel or other suitable metal, which electrode is coated on or adhered to a support (not shown) made of any suitable material, e.g., a polymeric material. The support may be included in a web, or may surround a metallic drum so as to form an intermediate member roller, e.g., intermediate member 16. Alternatively, layer 34 may be semiconductive. FIG. 5*b*, in which primed (') entities correspond to unprimed entities in FIG. 5*a*, illustrates the result of corona charging an initially uncharged drop 31 of a primary image which has been translated beneath a (stationary) corona charging device 37. The resulting corona-charged drop 31' is shown resting on operational surface 38' moving to the left as indicated by arrow G. The polarity of the corona ions emitted from device 37 is the same as that of particles 32' (here positive) so that for example positive corona ions 36*a* are shown at the outer surface of drop 31' in non-injecting contact with the carrier liquid 39'. Other non-injecting corona ions 36*b* are shown charging an ink-free surrounding area where no ink jet ink was deposited. Induced counter charges 35' on electrode 35' provide an electric field in layer 34' and within the drop 31'. As a result of the field within drop 31', particles 32' are shown as having migrated towards the operational surface 38' where they preferably form a compact layer held down by the electrostatic attraction from the corresponding countercharges 35' as well as by dispersion or van der Waals type attractive forces. The counterions or micelles 33' migrate towards the outer surface of drop 31', thereby compensating or neutralizing the corona charges 36*a*. As a beneficial effect of layer 34' being preferably insulating, and with surfaces 38' and electrode 35' preferably forming blocking contacts for charge injection, the surface charges 36*b* counteract an electrostatic spreading force that would otherwise act to make drop 31' tend to spread laterally by Coulombic repulsive forces (if for example layer 34' were semiconductive and charges 36*b* and their corresponding countercharges on electrode 35' were not present). Moreover, owing to the electroneutrality of the charged drop 31' (excluding the charged particles 32') the liquid located above particles 32' has no net attractive electrostatic force to the substrate, so that this liquid may be more readily removed in an Excess Liquid Removal Process Zone such as Process Zone 13 (possible ways are indicated by arrows g, h, i, j, and k in FIG. 4 as described later below). Corona charging device 37 includes any known corona charger, e.g., an AC or a DC charger, and may further include one or both of a plurality of corona wires and a grid.

Figure 6A:
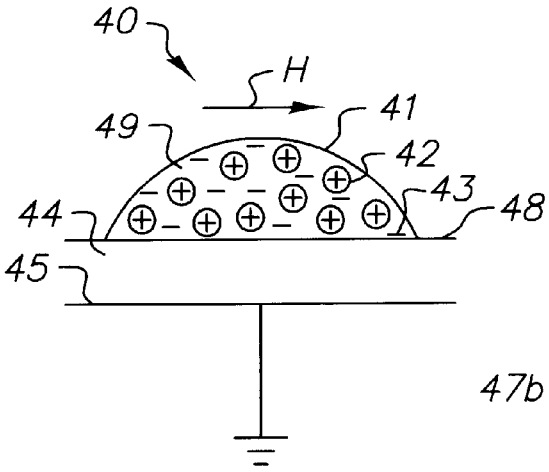
FIGS. 6*a*, 6*b*, and 6*c* schematically illustrate the effect of using a non-contacting electrode for concentrating a primary ink jet image on an intermediate member.
Figure 6B:
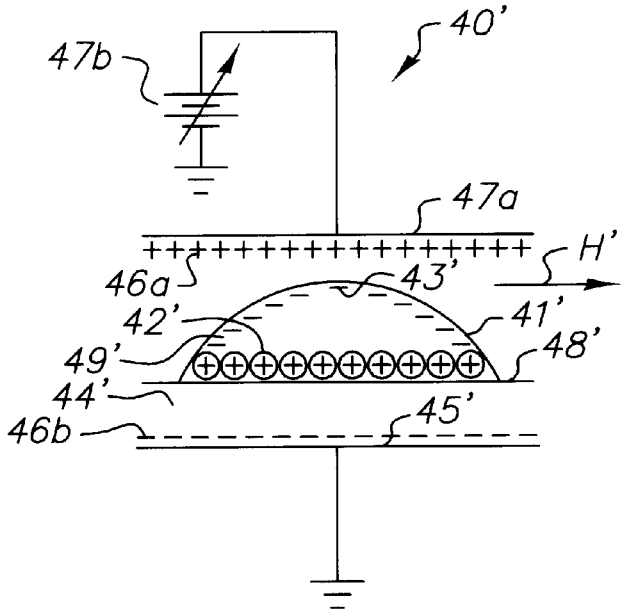
Figure 6C:
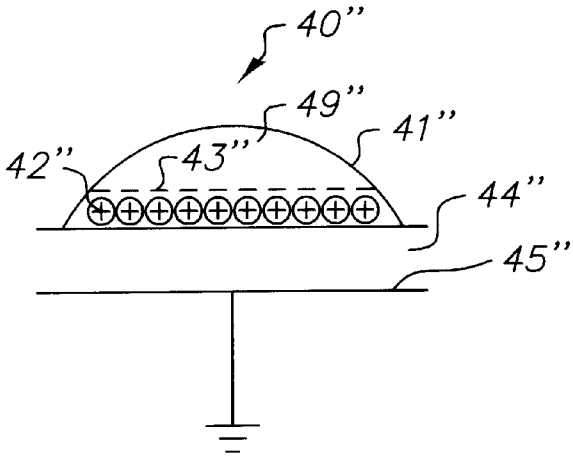

Another preferred embodiment having an Image Concentration Process Zone shown generically as 12 in FIG. 2 includes a non-contacting electrode device for concentrating the primary image. Use of such a device is indicated by arrow, e, in FIG. 4. As shown in schematic side view in FIG. 6*a*, a single pixel 40 contains a drop 41 formed by a coalescence of one or more nonaqueous ink jet ink droplets deposited by an ink jet device such as device 11 on an operational surface 48, e.g., of intermediate member 16. Elements 42, 43, 44, 45, 48 and 49 are the same in all respects as corresponding elements 32, 33, 34, 35, 38 and 39 of FIG. 5*a*. Operational surface 48 is shown moving to the right in direction of arrow H. FIG. 6*b*, in which single primed (') elements correspond to the unprimed elements of FIG. 6*a*, shows the operational surface 48' moving in direction of arrow H' underneath a biased (stationary) non-contacting electrode 47*a* connected to a variable voltage supply 47*b*, which electrode is in close proximity to drop 41'. The electrode 47*a* is biased to the same polarity as that of particles 42' (here positive). Positive charges 46*a* on electrode 47*a* induce countercharges 46*b* (here negative) on electrode 45', thereby producing an electric field which polarizes drop 41' such that the counterions or micelles 43' migrate to the surface of drop 41', and the charged particles 42' migrate towards the operational surface 48' where a compact layer is formed with the particles in direct contact with one another and with surface 48'. FIG. 6*c*, in which the double primed (") elements correspond to the single primed elements of FIG. 6*b*, shows drop 41" after it has moved away from the influence of electrode 47*a*. By virtue of dispersion or van der Waals type attractive forces, particles 42" are adhered to operational surface 48", and the neutralizing counterions 43" are attracted into close proximity also. Owing to the electroneutrality of the drop 41" the carrier-free liquid located above particles 42" is readily removed in an Excess Liquid Removal Process Zone such as Process Zone 13 (possible ways are indicated by arrows g, h, i, j, and k in FIG. 4 as described later below).

Figures 7A, 7B, 7C:
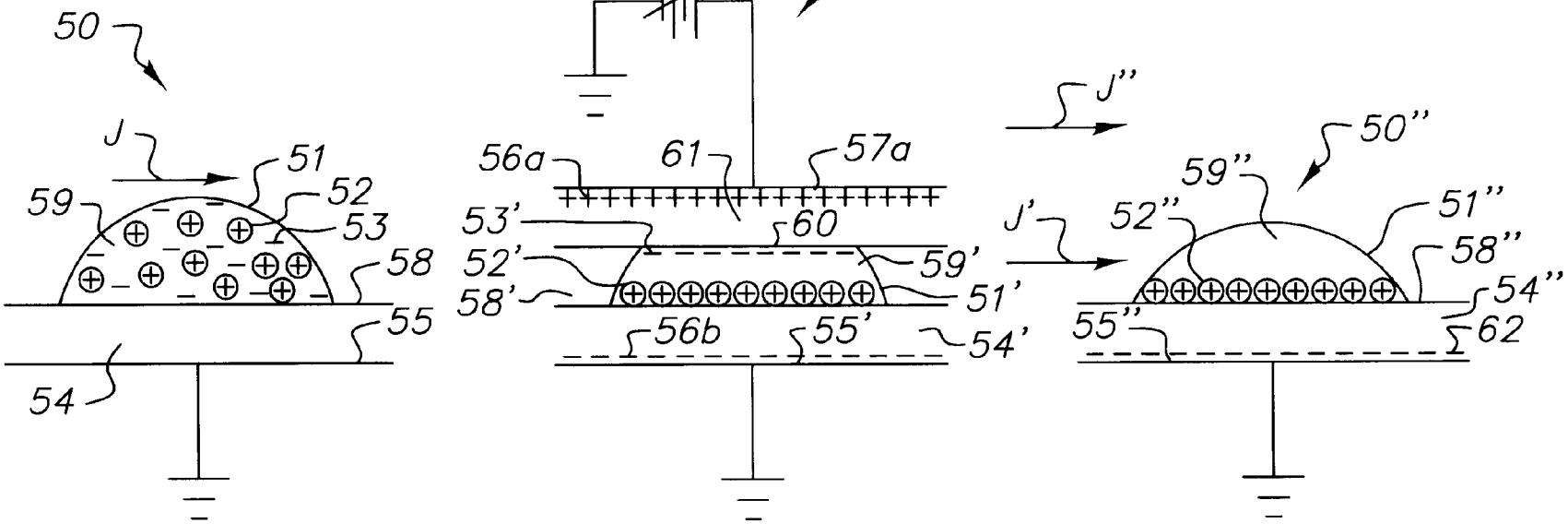
FIGS. 7*a*, 7*b*, and 7*c* schematically illustrate the effect of using a contacting electrode for concentrating a primary ink jet image on an intermediate member.

Yet another preferred embodiment having an Image Concentration Process Zone shown generically as 12 in FIG. 2 includes a contacting electrode device for concentrating the primary image. Use of such a device is indicated by arrow, d, in FIG. 4. As shown in schematic side view in FIG. 7*a*, a single pixel 50 contains a drop 51 formed by a coalescence of one or more nonaqueous ink jet ink droplets deposited by an ink jet device such as device 11 on an operational surface 58, e.g., of intermediate member 16. Elements 52, 53, 54, 55, 58 and 59 are the same in all respects as corresponding elements 32, 33, 34, 35, 38 and 39 of FIG. 5*a*. Operational surface 58 is shown moving to the right in direction of arrow J. FIG. 7*b*, in which single primed (') elements correspond to the unprimed elements of FIG. 7*a*, shows the operational surface 58' moving in direction of arrow J' underneath a biased contacting electrode 57*a* connected to a variable voltage supply 57*b*. Electrode 57*a* is preferably covered by a thin layer or layers 61, which layer is preferably insulating. Alternatively, layer 61 is semiconductive. The thickness of layer(s) 61 is not critical, but is preferred to be thinner than about 1 millimeter and more preferably thinner than about 10 micrometers. The lower surface 60 of layer 61 is in contact with and may squash or deform drop 51'. For simplicity of exposition, surfaces 58' and 60 are shown as non-contacting, parallel, uncurved, surfaces separated by a gap; however, the surfaces may not be parallel or may be curved, and certain portions of the gap may have different separations, including a vanishingly small or zero separation. Both layer 61 and electrode 57*a* of FIG. 7*b* may be included in a rotatable member (not illustrated as such) having the form of a drum or endless belt moving in the direction of arrow J", where the speeds in directions J' and J" may differ or be equal. Speed J" includes zero speed. Surface 60 is preferably wetted by the carrier liquid 59', although a non-wettable surface may be used in some cases. The electrode 57*a* is biased to the same polarity as that of particles 52' (here positive). Positive charges 56*a* on electrode 57*a* induce countercharges 56*b* (here negative) on electrode 55', thereby producing an electric field which polarizes drop 51' such that the counterions or micelles 53' migrate to the upper surface of drop 51', and the charged particles 52' migrate towards the operational surface 58' where a preferably compact layer is formed with the particles in direct contact with one another and with surface 58'. FIG. 7*c*, in which the double primed (") elements correspond to the single primed elements of FIG. 7*b*, shows a residual drop 51" after it has moved away from the influence of electrode 57*a*. Particles 52" are adhered to operational surface 58" as a result of electrostatic attraction between particles 52" and countercharges 62 on electrode 55", and also by virtue of dispersion or van der Waals type attractive forces. The number of countercharges 62 is smaller than the number of countercharges 56*b*. Using a surface 60 which can absorb carrier liquid 59' or is wettable by carrier liquid 59', a portion of the carrier liquid will tend to be absorbed or adhere to surface 60, thus diminishing the amount of liquid in residual drop 51" (as depicted). Moreover, electrostatic attraction between the counterions or micelles 53' and the charges 56*a* will cause the counterions or micelles to be transferred to surface 60, or to be neutralized at surface 60 if layer(s) 61 is semiconductive. Thus the capacitance of preferably insulating layer 54" ends up in a charged condition as shown in FIG. 7*c*. The substantially carrier-free liquid located above particles 52" is readily removed in an Excess Liquid Removal Process Zone such as Process Zone 13 (possible ways are indicated by arrows g, h, i, j, and k in FIG. 4 as described later below). When the material of layer(s) 61 is absorbent so that a portion of liquid 59' is absorbed or blotted, or when surface 60 is wetted by liquid 59', a smaller amount of liquid 59" will be in residual drop 51" than in the original drop 51 of FIG. 7*a*. When both layer 61 and electrode 57*a* of FIG. 7*b* are be included in a rotatable member, any liquid removed by adhesion to surface 60 or absorbed in layer(s) 61 may be removed from the rotatable member at a location distanced from the location where the rotatable member is in proximity to the operational surface 58.

Figure 8B:
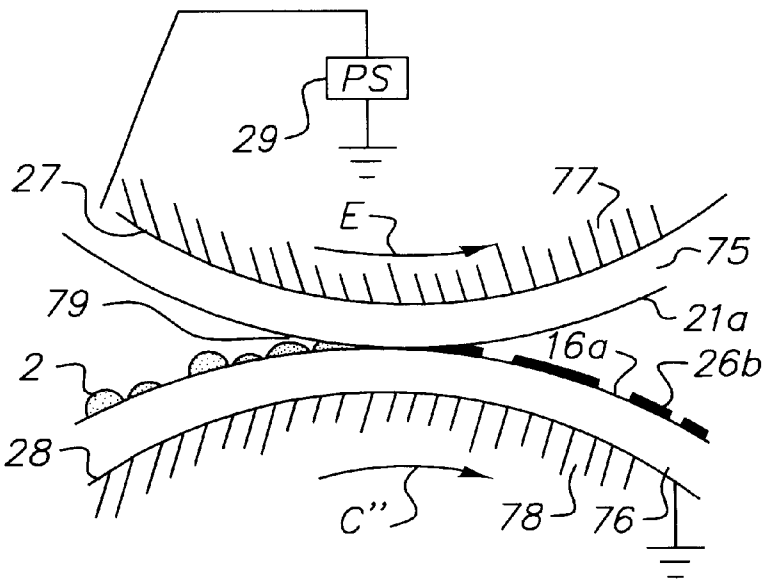
FIG. 8*b* shows an enlarged schematic side elevational view of a portion of the apparatus of FIG. 8*a*, including components not shown in FIG. 8*a;*
Figure 8A:
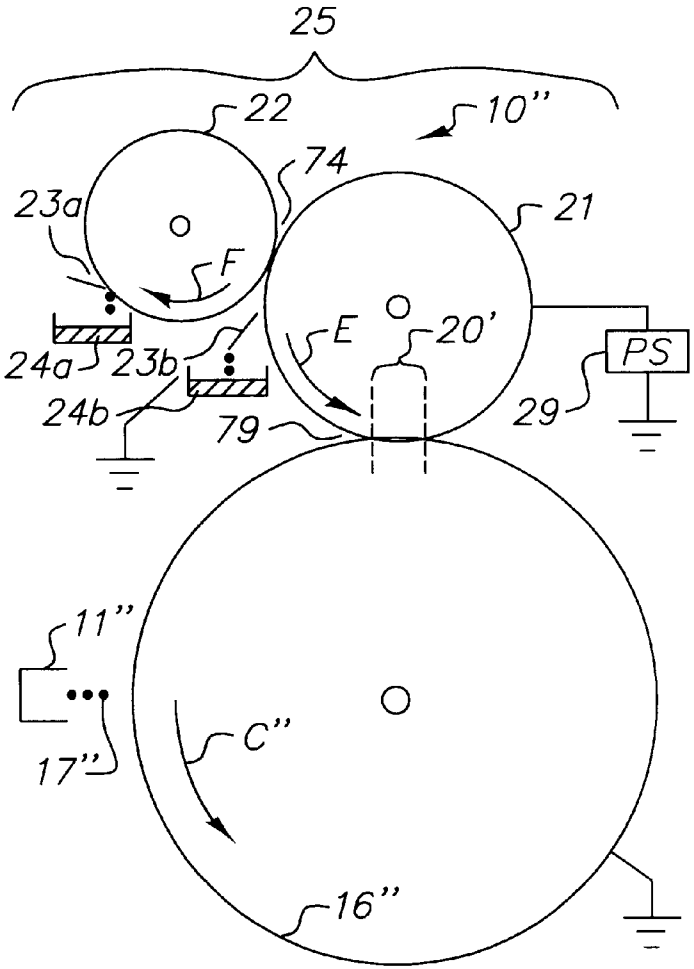
FIG. 8*a* shows a schematic side elevational view of a blotting device as an embodiment for use in the Image Concentration/Liquid Removal Process zone generically indicated in the apparatus of FIG. 3.

Still yet another preferred embodiment having an Image Concentration/Liquid Removal Process Zone shown generically as 20 in FIG. 2 includes a contacting device 25 shown in FIG. 8 which uses an external blotting member for simultaneously concentrating and blotting the primary image. Use of such a device combines the effects indicated by the arrows, d and h, in the flow diagram of FIG. 4. FIG. 8*a* schematically shows a portion of an imaging apparatus 10" in which double primed (") entities are equivalent to corresponding single primed (') entities in FIG. 2. Shown are ink jet device 11", ink 17", intermediate member 16", and an image concentration/liquid removal contacting device 25 for use in Image Concentration/Liquid Removal Process Zone indicated as 20'; Transfer and Regeneration Process Zones included in this embodiment have been omitted from FIG. 8*a* for clarity. Image concentration/liquid removal apparatus 20' includes a blotting or liquid-absorbing roller 21 rotating in direction of arrow E and in engagement with intermediate member 16", and a secondary roller 22 rotating in direction of arrow F and in engagement with roller 21. With roller 22 electrically grounded as shown, roller 21 is electrically biased by a voltage produced by power supply (PS) 29. FIG. 8*b* schematically shows an enlarged view including a zone of engagement 79 between intermediate member 16" and roller 21. A primary image formed by ink jet device 11" includes individual pixels containing variable amounts of deposited ink coalesced from a variable number of ink droplets 17" jetted by device 11" on to each pixel of operational surface 16*a* of intermediate member 16", thereby forming drops 26*a*. The preferred ink 17" for use in this embodiment is nonaqueous and contains charged particles and oppositely charged counterions or micelles colloidally dispersed in a carrier fluid. Operational surface 16*a* is included in a layer or layers 76 on the surface 28 of a grounded metallic drum 78. Layer 76 is preferably insulating, although in an alternative embodiment layer 76 may be semiconductive. Roller 21 has an outer surface shown as 21*a* which is included in a layer 75 on a drum 77. An electrode 27 is biased by a voltage from PS 29, which voltage has the same polarity as that of the charged particles included in the ink 17". Electrode 27 may be included in the outer surface of a metallic drum 77, or electrode 27 may be a thin conductive layer surrounding other layers (not shown). Alternatively, ink jet inks, including aqueous-based inks or inks containing uncharged or sterically stabilized particles, are used in apparatus 10" such that PS 29 may be not included or not used. Layer 75 is a preferably conformable, absorbent, blotting layer which may include an open cell foam or be otherwise porous in order for capillary forces to draw liquid into the interior of layer 75. It is also preferred that surface 21*a* is wettable by the carrier liquid of ink 17" and that the interior surface area of absorbent layer 75 is also wettable by the carrier liquid. Layer 75 is preferably insulating. Alternatively, layer 75 is semiconductive. As surface 16*a* rotates in direction of arrow C", ink drops 26*a* are moved into the zone of engagement 79 where the conformable blotting layer is gently squeezed while excess liquid is simultaneously absorbed into layer 75. The term "gently squeezed" refers to a relatively small deformation of conformable layer 75, which small deformation does not substantially affect an ability of layer 75 to absorb carrier liquid. The electrical bias provided by PS 29 produces an electric field which repels the charged particles of the preferred nonaqueous ink towards the surface 16*a* where a compacted layer of particles is formed, which compacted layer adheres to surface 16*a* and forms a liquid-depleted or "dried" material image 26*b* as surface 16*a* rotates away from the zone of engagement 79. It is preferred that the ink-jet-ink-derived material of image 26*b* does not adhere to surface 21*a*. Roller 22 in FIG. 8*b* is a blotting or liquid-absorbing porous roller which preferably absorbs, by transfer of liquid from roller 21 in a zone of engagement 74, most of the liquid carried away by roller 21 from the zone of engagement 79. Thus, the portion of layer 75 entering zone 79 has a restored absorbency. A blade 23*a* pressing against roller 22 may be used to squeeze liquid from roller 22, the liquid being captured for example in a vessel indicated as 24*a* from whence the liquid may be recycled. Alternatively, roller 22 is a squeeze roller, preferably hard and impermeable, which is pressed against roller 21, thereby squeezing out most of the liquid brought into zone 74 by roller 21, which liquid may be captured by a guide blade 23*b* and a vessel 24*b* (blade 23*a* and vessel 24*a* not being used in this alternate embodiment, and blade 23*b* and vessel 24*b* not being used in the previous embodiment in which roller 22 is a blotting roller).

An Alternative Embodiment Utilizing an Image Concentration/Liquid Removal Process Zone shown generically as 20 in FIG. 2, includes an electrically biased contacting external blotting roller for simultaneously concentrating and blotting the primary image on a rotatable intermediate member, which roller includes a vacuum device. The intermediate member co-rotates with the external blotting roller, thereby bringing the primary image into contact for the blotting process and subsequently carrying the liquid-depleted image away from the contact zone. This embodiment (not illustrated) includes in a single step a simultaneous combination of the mechanisms indicated by the arrows, d and h, in FIG. 4. The vacuum device (not shown) is connected to an interior chamber within the external blotting roller, which vacuum device is used to suck the liquid component of the primary image through a porous surface layer or layers of the external blotting roller into the interior chamber of the external blotting roller, which liquid component is sucked out of the interior chamber by the vacuum device (for possible recycling) through any suitable vent, e.g., through a hollow shaft having the form of a pipe connecting the vacuum device to the interior chamber of the external blotting roller. For preferred use with an ink which is a nonaqueous dispersion of particles, the external blotting roller of this embodiment includes an electrode connected to a source of voltage, which voltage provides an electric field, between the intermediate member and the external blotting member, for urging the particles of the ink in the primary image to move towards and adhere to the operational surface of the intermediate member.

The arrow, f, shown in FIG. 4 indicates an alternative method or apparatus (not illustrated) for concentrating a primary image, in which apparatus or method a magnetic field is provided in Image Concentrating Process Zone 12 of FIG. 2 to cause particles contained in a magnetizable ink to migrate towards the surface of an intermediate member to form a concentrated image. Thus, ink 17 may include a ferrofluid, or any suitable colloidal suspension of magnetizable particles, including colloidal suspensions of ferromagnetic or paramagnetic materials.

Notwithstanding that the evaporation and blotting mechanisms (indicated by the paths labeled by arrows a, b) are described above to form a "dried" or liquid-depleted image without first forming a distinguishable concentrated or "wet" image, blotting and evaporation may in certain embodiments be combined with any of the other mechanisms as indicated by arrows c, d, e, and f. For example, an intermediate member which blots, absorbs or imbibes may be used in concert with a corona charger, and so forth.

In general, after a concentrated "wet" image is formed from a primary image, the excess liquid may be removed using a squeegee roller or blade, an external blotter, heat, skiving, or an air knife, as indicated respectively by the arrows g, h, i, j, and k in FIG. 4. Specific devices for accomplishing the removal of excess liquid are not illustrated.

A contacting squeegee blade for removing excess liquid from a concentrated image on an intermediate member (arrow g) may generally include an electrically biasable element, e.g., connectable to a power supply, which biasable element repels charged particles in a concentrated image towards the operational surface of the intermediate member. A squeegee roller (or squeeze roller) for removing excess liquid from a concentrated image may be similarly biasable.

An external blotter (arrow h) for removing excess liquid from a concentrated image includes any suitable rotatable member, e.g., a blotting roller or an endless blotting belt, contacting the concentrated image. The external blotter may be regenerated by extracting the blotted liquid by a suitable mechanism, which mechanism includes a squeegee blade or a roller. A blotting roller may include an interior chamber connected to a source of vacuum, whereby liquid taken up or blotted from a concentrated image may be drawn through a porous layer into the interior chamber and extracted therefrom by the vacuum for recycling or disposal. Blotting or liquid extraction may also be accomplished by a source of vacuum external to the intermediate member.

A source of heat (arrow i) may be provided for evaporating excess liquid from a concentrated image. The source of heat may be located within the intermediate member, or it may be external, e.g., in the form of a heated roller or a source of radiant energy. A heated airflow directed towards a concentrated image may be used to evaporate excess liquid.

A skiving device (arrow j) may be used for removing excess liquid from a concentrated image. A skiving device includes a non-contacting blade for skimming off the excess liquid.

An air knife device (arrow k) may be used for removing excess liquid from a concentrated image. An air knife provides a jet of air, emerging from a slit which runs across the width of the operational surfaces of intermediate members 16, 16' parallel to the axes of shafts 21, 21' of FIGS. 2 and 3, which jet is typically directed at a low angle so as to blow excess liquid towards a location where an external vacuum device can suck the excess liquid away from the surface to create a liquid-depleted or "dried" image on the intermediate member.

Figure 9:
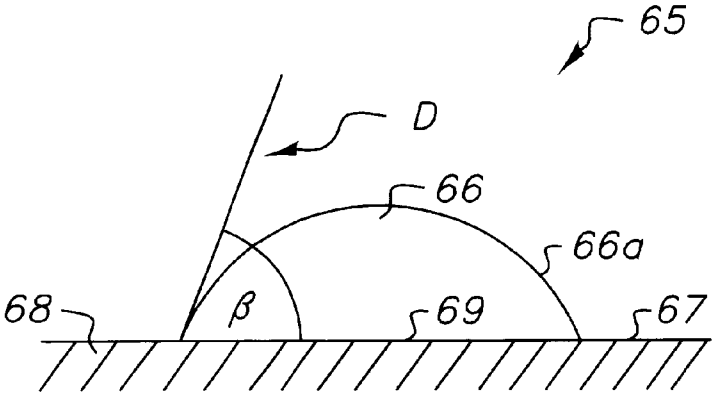
FIG. 9 schematically illustrates an as-deposited drop of ink jet ink on an intermediate member operational surface.

FIG. 9 shows a sketch of an approximately pixel-sized portion, indicated by the numeral 65, of an as-deposited primary image which includes a drop 66 formed by one or more ink droplets delivered from an ink jet device on to surface 67 of an intermediate member 68. The drop 66 has a liquid/air interface 66*a*, and an interfacial area 69 where the drop rests on the substrate. A spreading coefficient, SC, defined as the negative derivative of the free energy with respect to area 69, is given by a well-known equation:

$$SC=\gamma^{SV}-\gamma^{SL}-\gamma^{LV}.\cos\beta$$

where $\gamma^{SV}$, $\gamma^{SL}$, and $\gamma^{LV}$ are, respectively, surface free energies per unit area of the substrate/air interface (surface 67), the surface/liquid interface (surface 69) and the liquid/air interface (surface 66*a*), with angle β determined by a line labeled D drawn tangent to surface 66*a* at a point of intersection of surface 66*a* and interface 69. If SC is positive, drop 66 will tend to spread spontaneously, thereby reducing angle β and increasing area 69, which may result in an undesirable blurring of a primary image. If SC is negative, the reverse is true, and area 69 will tend to shrink. A large shrinkage of area 69 may cause an undesirable balling up of drop 66. It is preferred, therefore, that at a time which is substantially the time at which drop 66 is formed by an ink jet device, SC is zero. This is accomplished by an appropriate choice of materials for the carrier liquid in drop 66 and for the outer surface of intermediate member 68. It is also preferred that an initial area 69 produced at the time of formation of drop 66 remains substantially the same until at least a time at which drop 66 is acted upon in an Image Concentrating Process Zone, or in an Excess Liquid Removal Process Zone, or in an Image Concentration/Liquid Removal Process Zone, e.g., Process Zones 12, 13 and 20. It is further preferred that area 69 remains substantially unaltered during passage through an Image Concentrating Process Zone, an Excess Liquid Removal Process Zone, or an Image Concentration/Liquid Removal Process Zone. However, should changes of area 69 occur as a result of a free-energy-driven spreading or shrinking, it is preferred that such changes occur slowly, i.e., in a period of time long compared to the time between deposition of a primary image and formation of a liquid-depleted or "dried" image. A spreading of drop 66 is typically associated with a strong propensity of drop 66 to wet surface 67, and conversely, a balling up of drop 66 is typically associated with a non-wetting contact in area 69. Hence, it is preferred that a drop 66 neither strongly wets surface 67 nor is strongly repelled by surface 67. When drop 66 is formed from a nonaqueous ink, surface energy $\gamma^{LV}$ is typically relatively low, and intermediate member 68 may be provided with a relatively low surface energy $\gamma^{SV}$ so that balling up of drops is thereby minimized and transfer of a liquid-depleted "dried" image to a receiver is enhanced.

In certain embodiments, drop spreading in a primary image may be inhibited by providing an intermediate member with a non-smooth operational surface. A surface roughness may be defined in terms of an average spatial wavelength parallel to surface 67 and an average amplitude normal to surface 67. It is preferred to provide a surface roughness of surface 67 wherein the average spatial wavelength is smaller than the width of a pixel, and the average amplitude is of the same order of magnitude as the average spatial wavelength. The average spatial wavelength of the surface roughness of surface 67 is preferably in a range of approximately between 0.01 and 0.3 pixel widths, where one pixel width is the reciprocal of the spatial frequency of the image (e.g., a spatial frequency of 400 dpi is equivalent to a pixel width of 63.5 micrometers).

Figure 10B:
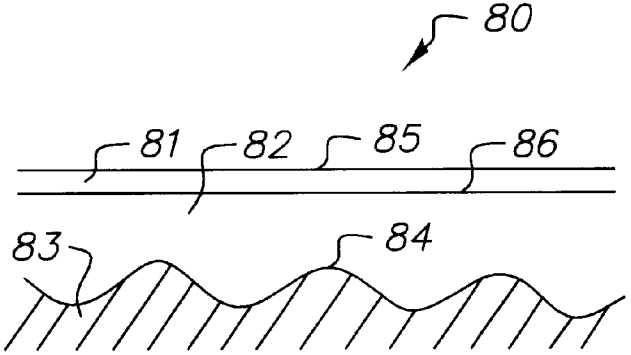
FIG. 10*b* schematically shows a cross-section of a portion of an alternative intermediate member of the invention.
Figure 10A:
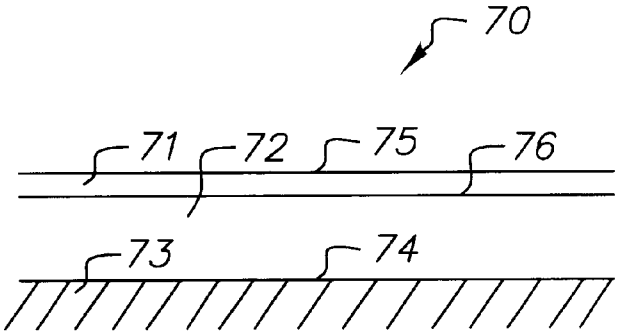
FIG. 10*a* schematically shows a cross-section of a portion of an intermediate member of the invention.

FIG. 10*a* schematically shows a cross-section of a portion of an intermediate member of the invention, indicated as embodiment 70, which includes a preferably compliant layer 72 formed on a support 73 and an optional thin outer layer 71 formed on layer 72. Support 73 is preferably a metallic drum, e.g., made of aluminum or any other suitable metal, which drum in certain embodiments described above is connected to ground potential, or connected to a suitable voltage from a source of potential such as a power supply, when an electric field is required between the drum and an external electrode or when a corona charging device is used. In an alternative embodiment, a thin conductive electrode layer (not shown) may be provided sandwiched between layers 71 and 72 which layer in certain embodiments described above is connected to ground or to a power supply when an electric field is required between the drum and an external electrode or when a corona charging device is used. In another alternative structure, support 73 and a flexible layer 72 plus optional thin outer layer 71 are included in an endless web. In this alternative embodiment, a thin flexible conductive electrode layer 74 may be provided sandwiched between layer 72 and support 73, which support may include polymeric materials including reinforced materials, and which thin flexible conductive electrode layer in certain embodiments described above is connected to ground or to a power supply when an electric field is required between the drum and an external electrode or when a corona charging device is used. In another alternative embodiment, support 73 is included in a linearly-movable platen, or adhered to a linearly-movable platen.

Layer 72 has a thickness preferably in a range of approximately between 0.5 mm and 10 mm, and more preferably, between 0.5 mm and 3 mm. In certain embodiments, layer 72 is electrically insulating. In other embodiments, layer 72 is semiconducting and has a resistivity preferably less than approximately $10^{10}$ ohm-cm and more preferably less than $10^{7}$ ohm-cm. Layer 72 is preferably made from a group of materials including polyurethanes, fluoroelastomers, and rubbers including fluororubbers and silicone rubbers, although any other suitable material may be used. For controlling resistivity, layer 72 may include a particulate filler or may be doped with compounds such as for example antistats. In embodiments in which outer layer 71 is not included, the outer surface 76 of layer 75 is preferred to have a suitable surface energy and roughness as described above, and the surface energy of outer surface 76 may be controlled within a suitable range by a thin coating (not shown) of any suitable surface active material or a surfactant.

To enhance the strength of dispersion or van der Waals type attractive forces between ink particles and an intermediate member so as to help stabilize a concentrated image prior to removing any excess liquid to form a "dried" image, layer 72 preferably has a high dielectric constant. For example, a polyurethane having a dielectric constant of about 6 is particularly useful, as compared with many common polymers having a dielectric constant close to 3. Fluoropolymers are also useful in this regard. Suitable particulate fillers may be provided in layer 72 to increase the dielectric constant.

Optional layer 71 has a thickness preferably in a range of approximately between 1 micrometer and 20 micrometers. Layer 71 is preferred to be both flexible and hard, and is preferably made from a group of materials including sol-gels, ceramers, and polyurethanes. Other materials, including fluorosilicones and fluororubbers, may alternatively be used. Layer 71 preferably has a high dielectric constant and suitable particulate fillers may be provided in layer 71 to increase the dielectric constant. The outer surface 75 of layer 71 is preferred to have a suitable surface energy and roughness, as described above, and the surface energy of outer surface 75 may be controlled within a suitable range by a thin coating (not shown) of any suitable surface active material or a surfactant.

FIG. 10*b* schematically shows a cross-section of an alternative embodiment 80 of a rotatable intermediate member of the invention. Elements 81, 82, 83, 84, 85, and 86 correspond to elements 71, 72, 73, 74, 75, and 76 and have the same respective bulk and surface properties, e.g., physical, chemical, and electrical. Embodiment 80 differs from embodiment 70 in that the support 83 has a corrugated or textured upper surface 84, in contrast to a substantially non-textured upper surface 74 of support 73. The average thickness of layer 82, which is formed with a relatively smooth upper surface 86, is in a range approximately the same as that of layer 72. The corrugation or texturing of surface 84 may include furrows parallel to one dimension (seen end on in the sketch of FIG. 9*b*) or it may have a hill-and-valley shape structured along two dimensions, i.e., with the hills and valleys deviating from a plane that is parallel with the plane of outer surface 86 of layer 82. The corrugations or the hill-and-valley shape may be regular, e.g., periodic in one or two dimensions, respectively, or alternatively they may be aperiodic or random wherein the heights, depths and widths of the hills and valleys vary randomly. The geometry of surface 84 can be characterized by an average wavelength and an average amplitude. For a hill-and-valley shape structured in two dimensions, the average wavelength is preferably the same in both dimensions and the average amplitude is preferably the same in both dimensions. The average wavelength of the structure of surface 84 is preferably in a range of approximately between 0.3 and 5 pixel widths, and more preferably between 0.5 and 2 pixel widths. It is further preferred that the average amplitude of the structure of surface 84 is of the same order of magnitude as the average spatial wavelength.

Figure 11:
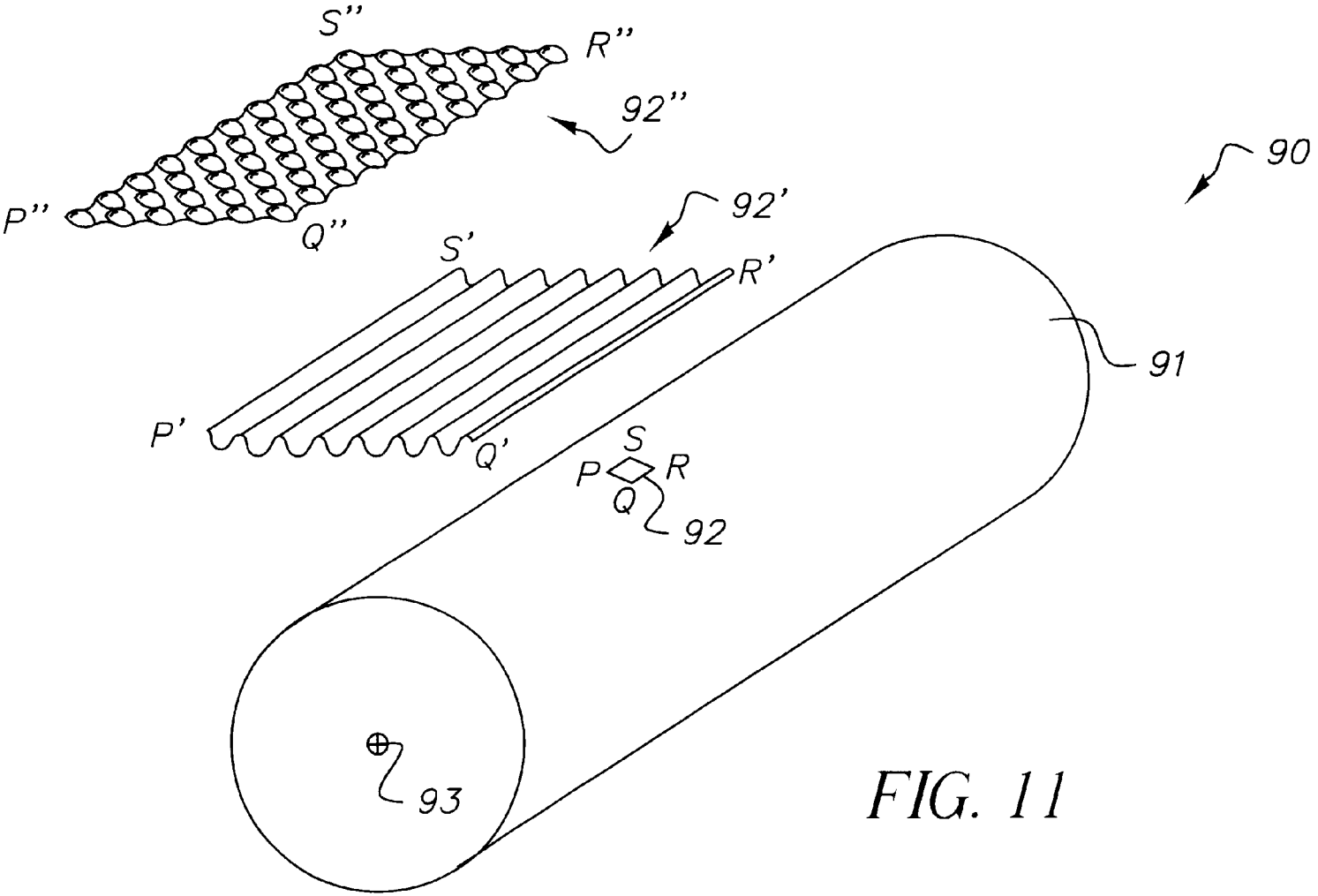
FIG. 11 illustrates schematically an intermediate member roller, which includes a textured surface.

FIG. 11 schematically illustrates an embodiment of a supporting member in the form of a textured drum, indicated as 90, for use to be included in an intermediate roller of the invention. A cylindrical textured surface 91 of the drum is shown as bare, i.e., coatings otherwise included for an intermediate member are not shown. A small portion 92 of surface 91 is indicated by the quadrilateral PQRS, having edges PS and QR parallel to the axis of a coaxial shaft 93 of drum 90, and edges PQ and RS perpendicular to shaft 93. An enlargement P'Q'R'S' illustrates an embodiment having a one-dimensionally periodic corrugated or furrowed surface with the furrows running parallel to the axis of shaft 93. However, the furrows may be made along any surface direction. Alternatively, as discussed above, the furrowed structure may be aperiodic or random, wherein the heights, depths and widths of the hills and valleys vary randomly. An alternative embodiment having a two-dimensionally periodic surface is shown in another enlargement, P"Q"R"S". Any two-dimensionally periodic structure may be used, and such a periodic structure may have any orientation and belong to any space group. Alternatively, as discussed above, the hill-and-valley structure may be aperiodic or random, wherein the heights, depths and widths of the hills and valleys vary randomly. The average spatial frequency and average amplitude of any textured or corrugated structure of surface 91, including the periodic embodiments P"Q"R"S" and P"Q"R"S", have the same ranges as disclosed above for embodiment 80.

For any of the thermal transfer embodiments described above in relation to FIG. 2, the materials included in the exterior of an intermediate member, e.g., intermediate members 16, 16', 16", 70, and 80 are selected to be resistant to thermal degradation induced by heat from the transfer operation. Moreover, for thermal transfer embodiments which include either an internal or an external heat source for the intermediate member, particulate fillers may be included in, for example, layers 71, 72, 81 or 82 for providing an efficient transport of heat through these layers.

Figure 12:
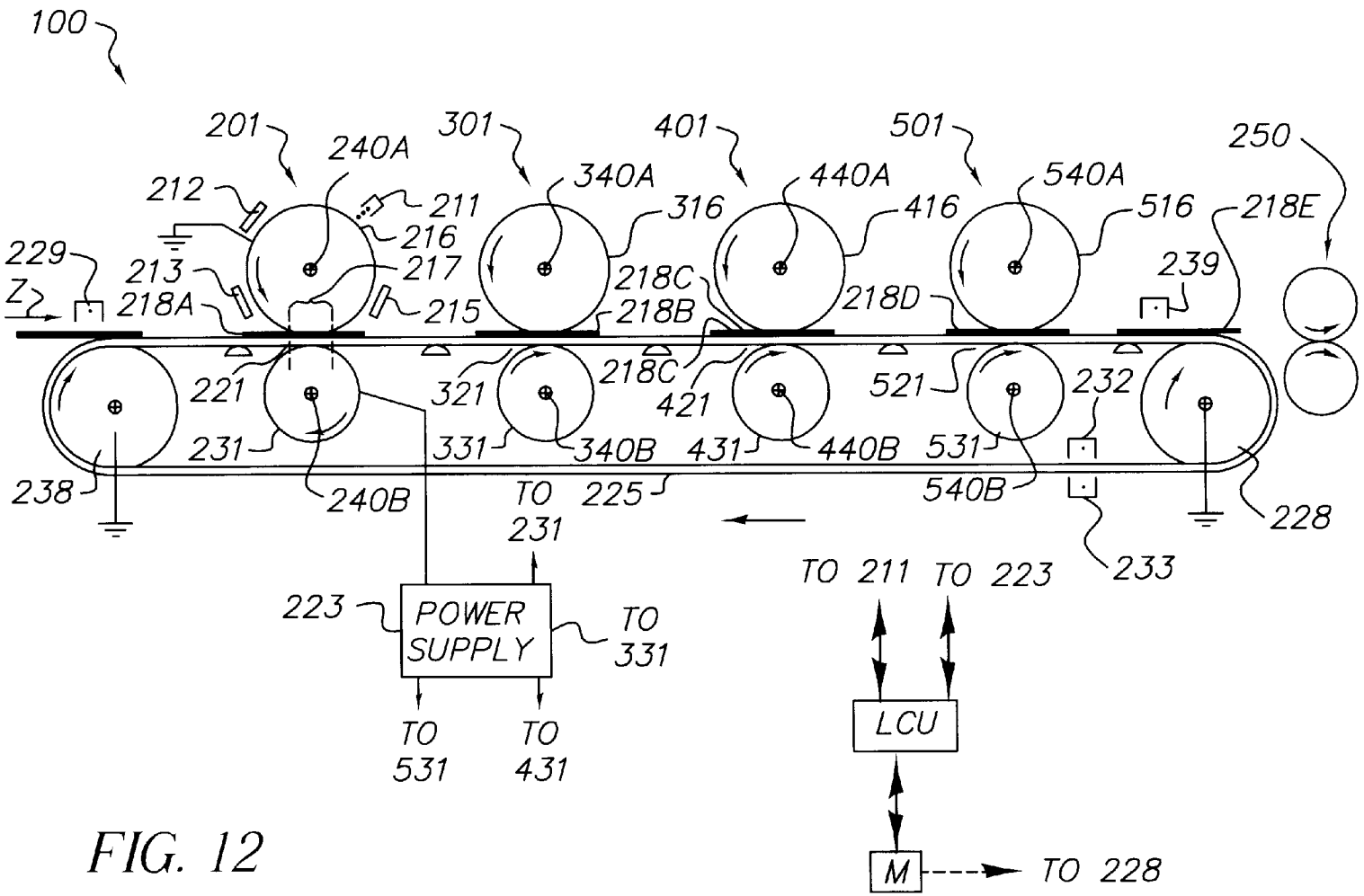
FIG. 12 is a schematic side elevational view of another embodiment of an apparatus of the invention showing both specific and generalized components thereof.

FIG. 12 shows a preferred modular color ink jet printing apparatus 100 including a plurality of modules of the type shown and described above for the embodiments of FIG. 2. Each ink jet module 201, 301, 401 and 501 produces a different color half-tone or continuous tone image and all operate simultaneously to construct a four-color ink-jet-ink-derived material image. For example, the colors in order from left to right may be black, cyan, magenta and yellow. With regard to image module 201, there are shown an ink jet device 211 and image formation zones 212 and 213 for creating an ink-jet-ink-derived image on the intermediate member (IM) 216 and a similar ink jet device and image formation zones are also associated with the IMs 316, 416 and 516 but not illustrated. Using an ink jet ink which is preferably a nonaqueous colloidal dispersion of charged pigmented particles in a carrier liquid as described above, the ink jet device 211 deposits a primary ink jet image to IM 216 which is in the form of a drum or roller. The primary ink jet image on the intermediate member is rotated to an Image Concentrating Process Zone 212 which includes any image concentrating mechanism as described above, wherein a concentrated image is formed from the primary ink jet image. The concentrated ink jet image on the intermediate member is then rotated to an Excess Liquid Removal Process Zone 213 which includes any excess liquid removal mechanism as described above, wherein excess liquid is removed from the concentrated image to form a liquid-depleted or "dried" ink-jet-ink-derived material image on IM 216. The liquid-depleted or "dried" image is transferred in a Transfer Process Zone 217, preferably electrostatically, to a receiver sheet 218A adhered to and transported by an insulative transport web (ITW) 225 moving through a transfer nip 221 formed by an engagement between IM 216 and a transfer backup roller (TBR) 231. Receiver sheets are fed successively in the direction of arrow Z to the surface of ITW 225 from a receiver supply unit (not shown), and the receiver sheets, e.g., 218A, are preferably adhered to ITW 225 via electrostatic hold down such as provided by a charging device 229. Other modules have respective transfer nips 321, 421, 521 between a respective intermediate member (IM) and a respective TBR. The material characteristics and dimensions of layers included in IM 216 are similar in all respects to the described material characteristics and dimensions of layers included in similarly functional members 70, 80 and 90 of FIGS. 10*a,b*, and 11, and similarly for the other modules. However, any suitable materials and dimensions may be used for IM 216. The natures of the ink jet device 211 and the ink used therein are both characterized as disclosed above, e.g., with reference to FIG. 2. Also, the Image Concentrating Process Zone 212 and the Excess Liquid Removal Process Zone 213 are both characterized as disclosed above, i.e., they respectively include suitable mechanisms as described above with reference, e.g., to FIGS. 2, 4, 5, 6, 7, 10 and 11. Although not explicitly shown in FIG. 12, in alternative embodiments the Image Concentrating Process Zone 212 and the Excess Liquid Removal Process Zone 213 may be combined into a single zone, as disclosed above for Applicator Process Zone 20 with further reference to FIGS. 3 and 8. Preferably, an ink jet ink used in ink jet device 211 is a nonaqueous ink formulated to contain charged pigmented particles, which charged pigmented particles are retained in the liquid-depleted or "dried" image for transfer in a Transfer Process Zone 217 to a receiver sheet 218A through the action of an electric field that urges the liquid-depleted image to receiver 218A. An electrical power supply 223 applies to TBR 231 a voltage, e.g. a DC electrical voltage bias of proper polarity, to attract the charged pigmented particles of the liquid-depleted image to transfer to the receiver 218A. In certain cases, the liquid-depleted image leaving Process Zone 213 may contain insufficiently charged, uncharged, or electrically neutralized pigmented particles, and in such cases a charging member (not illustrated) e.g., a corona charger or a roller charger may be used to deposit an image-conditioning electrostatic charge to the particles in order to make them electrostatically transferable to receiver 218A. After transfer in Transfer Process Zone 217, the surface of the rotating intermediate member 216 is moved to a Regeneration Process Zone 215 wherein any untransferred remnants of the liquid-depleted image, which may include other debris and residual liquid, are cleaned from the surface of IM 216 and the surface is prepared for reuse for forming the next primary ink jet image having the particular color toner associated with this module. The Regeneration Process Zone 215 includes any mechanism including the mechanisms described above, e.g., with reference to FIGS. 2, 3. In this embodiment, a single transport web 225 in the form of an endless belt serially transports each of the receiver members or sheets 218A, 218B, 218C and 218D through four transfer nips 221, 321, 421 and 521 formed by the IMs 216, 316, 416 and 516, respectively of each module with respective transfer backup rollers 231, 331, 431 and 531 where each color separation image is transferred in turn to a receiver member so that each receiver member receives up to four superposed registered color images to be formed on one side thereof.

Registration of the various color images requires that a receiver member be transported through the modules in such a manner as to eliminate any propensity to wander and an ink-jet-ink-derived material image being transferred from an intermediate transfer roller in a given module must be created at a specified time. The first objective may be accomplished by electrostatic web transport whereby the receiver is held to the transport web (ITW) 225 which is a dielectric or has a layer that is a dielectric. A charger 229, such as a roller, brush or pad charger or corona charger may be used to electrostatically adhere a receiver member onto the web. The second objective of registration of the various stations' application of color images to the receiver member may be provided by various well known means such as by controlling timing of entry of the receiver member into the nip in accordance with indicia printed on the receiver member or on a transport belt wherein sensors sense the indicia and provide signals which are used to provide control of the various elements. Alternatively, control may be provided without use of indicia using a robust system for control of the speeds and/or position of the elements. Thus, suitable controls including a logic and control unit (LCU) can be provided using programmed computers and sensors including encoders which operate with same as is well known in this art.

Additionally, the objective may be accomplished by adjusting the timing of the delivery of each of the primary ink jet images; e.g. by using a fiducial mark laid down on a receiver in the first module or by sensing the position of an edge of a receiver at a known time as it is transported through a machine at a known speed. As an alternative to use of an electrostatic web transport, transport of a receiver through a set of modules can be accomplished using various other methods, including vacuum transport and friction rollers and/or grippers.

In the apparatus 100 of FIG. 12, each module 201, 301, 401 and 501 is of similar construction and as shown one transport web operates with all the modules and the receiver member is transported by the ITW 225 from module to module. Four receiver members or sheets 218A, B, C and D are shown receiving ink-jet-ink-derived material images from the different modules, it being understood as noted above that each receiver member may receive one ink-jet-ink-derived color image from each module and that up to four color images can be received by each receiver member. Each color image may be a color separation image. The movement of the receiver member with the transport belt (ITW 225) is such that each color image transferred to the receiver member at the ink-jet-ink-derived image transfer nip (221, 321, 421, 521, respectively) of each module formed with the transport belt is a transfer that is registered with the previous color transfer so that a four-color ink-jet-ink-derived material image formed in the receiver member has the colors in registered superposed relationship on the receiver member. The receiver members are then transported to a fusing station 250 as is the case for all the embodiments to fuse the ink-jet-ink-derived material images to the receiving member, e.g., using heat and pressure as necessary. A detack charger 239 or scraper may be used to overcome electrostatic attraction of the receiver member to the ITW such as receiver member 218E upon which one or more ink-jet-ink-derived material images are formed. The transport belt is reconditioned by providing charge to both surfaces by opposed corona chargers 232, 233 which neutralize charge on the surfaces of the transport belt.

The insulative transport belt or web (ITW) 225 is preferably made of a material having a bulk electrical resistivity greater than $10^5$ ohm-cm and where electrostatic hold down of the receiver member is not employed, it is more preferred to have a bulk electrical resistivity of between $10^8$ ohm-cm and $10^{11}$ ohm-cm. Where electrostatic hold down of the receiver member is employed, it is more preferred to have the endless web or belt have a bulk resistivity of greater than $1\times10^{12}$ ohm-cm. This bulk resistivity is the resistivity of at least one layer if the belt is a multilayer article. The web material may be of any of a variety of flexible materials such as a fluorinated copolymer (such as polyvinylidene fluoride), polycarbonate, polyurethane, polyethylene terephthalate, polyimides (such as Kapton®), polyethylene napthoate, or silicone rubber. Whichever material that is used, such web material may contain an additive, such as an anti-static (e.g. metal salts) or small conductive particles (e.g. carbon), to impart the desired resistivity for the web. When materials with high resistivity are used (i.e., greater than about $10^{11}$ ohm-cm), additional corona charger(s) may be needed to discharge any residual charge remaining on the web once the receiver member has been removed. The belt may have an additional conducting layer beneath the resistive layer which is electrically biased to urge marking particle image transfer, however, it is more preferable to have an arrangement without the conducting layer and instead apply the transfer bias through either one or more of the support rollers or with a corona charger. The endless belt 225 is relatively thin (20 micrometers to 1000 micrometers, preferably, 50 micrometers to 200 micrometers) and is flexible.

In the embodiment of FIG. 12 a receiver member may be engaged at times in more than one image transfer nip and preferably is not in the fuser nip and an image transfer nip simultaneously. The path of the receiver member for serially receiving in transfer the various different color images is generally straight facilitating use with receiver members of different thickness. Support structures are provided before entrance and after exit locations of each transfer nip to engage the transport belt on the backside and alter the straight line path of the transport belt to provide for wrap of the transport belt about each respective intermediate member (IM) so that there is wrap of the transport belt of greater than 1 mm on the pre-nip side of the nip. This wrap allows for reduced pre-nip ionization. The nip is where the transfer backup or pressure roller contacts the backside of the web 225 or where no roller is used where an electrical field for electrostatic transfer of an ink-jet-ink-derived material image to a receiver sheet is substantially applied but preferably still a smaller region than the total wrap of the transport belt about the IM. The wrap of the transport belt about the IM also provides a path for the lead edge of the receiver member to follow the curvature of the IM but separate from engagement with the IM while moving along a line substantially tangential to the surface of the cylindrical IM. Preferably, the pressure of the backup rollers on the transport belt is 7 pounds per square inch or more. The electrical field in each nip is provided by an electrical potential provided to the IM and the backup roller. Typical examples of electrical potential might be ground potential of a conductive stripe or layer included in the intermediate member as indicated in FIG. 12, and an electrical bias of about 300 volts on the backup roller. The polarity would be appropriate for urging electrostatic transfer of the ink-jet-ink-derived material images and the various electrical potentials may be different at the different modules. In lieu of a backup roller, other mechanisms may be provided for applying the electrical field for transfer to the receiver member such as a corona charger or conductive brush or pad.

Drive to the respective modules is preferably provided from a motor M which is connected to drive roller 228, which is one of plural (two or more) rollers about which the ITW is entrained, e.g., including roller 238. The drive to roller 228 causes belt 225 to be preferably frictionally driven and the belt frictionally drives the backup rollers 231, 331, 431, 531 and also the respective IMs 216, 316, 416 and 516 in the directions indicated by the arrows so that the image bearing surfaces run synchronously for the purpose of proper registration of the various color separations that make up a completed ink-jet-ink-derived color image.

In order to overcome problems relating to overdrive or underdrive in each of the pressure nips 221, 321, 421, 521, a speed modifying device may be used, in manner as disclosed in copending U.S. Pat. No. 6,556,798 issued on Apr. 29, 2001 in the names of Donald S. Rimai et al., which speed modifying device applies a speed modifying force such as for example a drag force to either or both of rollers 216 and 231, or alternatively the speed modifying device may include a redundant gearing mechanism linking rollers 216 and 231. Similarly, a speed modifying device may be used to apply a speed modifying force to either or both of the other pairs of rollers, 316 and 331, 416 and 431, 516 and 531. In alternative embodiments, in order to overcome problems relating to overdrive or underdrive in the respective nips, an engagement adjustment device may be provided, such as disclosed in copending U.S. Pat. No. 6,549,745 issued on Apr. 15, 2003 in the names of John W. May et al., for adjusting an engagement in each of the pressure nips 221, 321, 421, 521 such that in nip 221 an engagement adjustment device moves one or both of shafts 240A and 240B keeping both shafts mutually parallel in order to control or eliminate overdrive in nip 221, and similarly for shafts 340A and 340B, 440A and 440B, 540A and 540B, respectively to adjust the engagements in the other nips 321, 421, 521, respectively.

Figure 13:
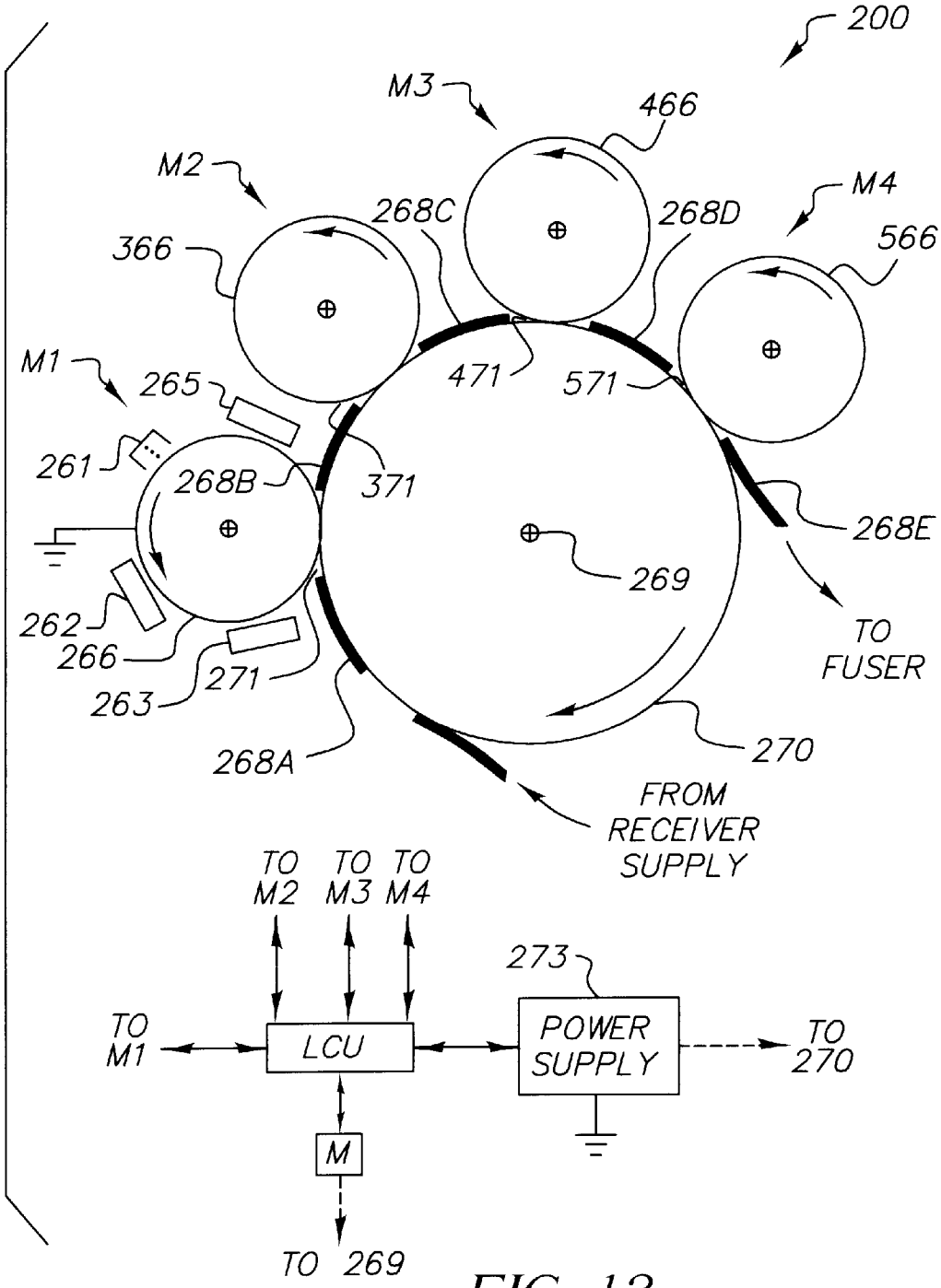
FIG. 13 is a schematic side elevational view of yet another embodiment of an apparatus of the invention showing both specific and generalized components thereof.

The invention is also applicable to an ink jet process and to other ink-jet-ink-derived material image transfer systems which employ rotatable members for transferring half-tone or continuous tone images in register to other members. The invention is also highly suited for use in other ink jet reproduction apparatus which employ rotatable members, such as, for example, those illustrated in FIGS. 13 and 14. In the apparatus 200 of FIG. 13, a plurality of color ink jet modules M1, M2, M3 and M4 are provided but situated about a large rotating receiver transporting roller 270. Roller 270 is of sufficient size to carry or support one or more, and preferably as shown, at least four receiver sheet members 268A,B,C,D on the periphery thereof so that a respective ink-jet-ink-derived material color image is transferred to each receiver member in respective nips 271, 371, 471, 571 as the receiver members each serially move from one color module to the other with rotation of roller 270. The receiver members are moved serially from a paper supply (not shown) on to the drum or roller 270 in response to suitable timing signals from a logic and control unit (LCU) as is well known. After being fed onto roller 270, the receiver member 268A may be retained on the roller by electrostatic attraction or gripper member(s). The receiver member, say 268A, then rotates past module M1 wherein an ink-jet-ink-derived material color image, i.e., a liquid-depleted or "dried" image formed on intermediate member or roller 266, is transferred from roller 266 to receiver 268A at a transfer nip 271 between roller 266 and roller 270. Following transfer, roller 266 rotates to a Regeneration Process Zone 265 where the intermediate member 266 is cleaned and prepared as described previously above to receive a new primary ink jet image from device 261. Each intermediate member 266, 366, 466, 566 in this embodiment has characteristics and materials as described for the previously described embodiments herein. The ink-jet-ink-derived material color image, for example black color, is formed on intermediate member (IM) 266 in a manner as described for prior embodiments, e.g., utilizing an ink jet device 261, an Image Concentrating Process Zone 262, and an Excess Liquid Removal Process Zone 263. Although not explicitly shown in FIG. 13, in alternative embodiments the Image Concentrating Process Zone 262 and the Excess Liquid Removal Process Zone 263 may be combined into a single zone, as disclosed above, e.g., with further reference to FIGS. 3 and 8. The ink for use in device 261 is a preferably nonaqueous colloidal dispersion of charged pigmented particles. The resulting liquid-depleted ink-jet-ink-derived material color image on roller 266, which contains charged pigmented particles from the dispersion, is transferred to a receiver preferably using electrostatic transfer. An auxiliary charging device (not shown) may be situated between device 263 and transfer nip 271, which auxiliary charging device can be used to augment the electrostatic charge of the liquid-depleted image prior to transfer to receiver 268A. Drive is provided from a motor M. The other members are frictionally driven by the member receiving the motor drive through friction drive at each of the nips. Thus, if roller 270 receives the motor drive at shaft 269, each IM is driven without slip by frictional engagement at the respective transfer nip. Each nip has the members under a suitable pressure, wherein overdrive or underdrive may be controlled in a manner as for apparatus 100. An electrical bias is provided by a power supply (PS) 273 to receiver transporting roller 270 to provide suitable electrical biasing for urging electrostatic transfer of a respective ink-jet-ink-derived material color image from a preferably electrically grounded respective IM such as IMs 266, 366, 466 and 566 to a respective receiver sheet. A plural ink-jet-ink-derived material color image is thereby formed on the receiver member as the receiver member moves serially past each color module to receive from the respective modules M1, M2, M3 and M4 respective color images, e.g., black, cyan, magenta and yellow images respectively, in register. After forming the plural color image on the receiver members, the receiver members, e.g., receiver 268E, are moved to a fusing station (not shown) wherein the ink-jet-ink-derived plural color images formed thereon are fixed to the receiver members. The color images described herein have the colors suitably registered on the receiver member to form full process color images similar to color photographs.

Figure 14:
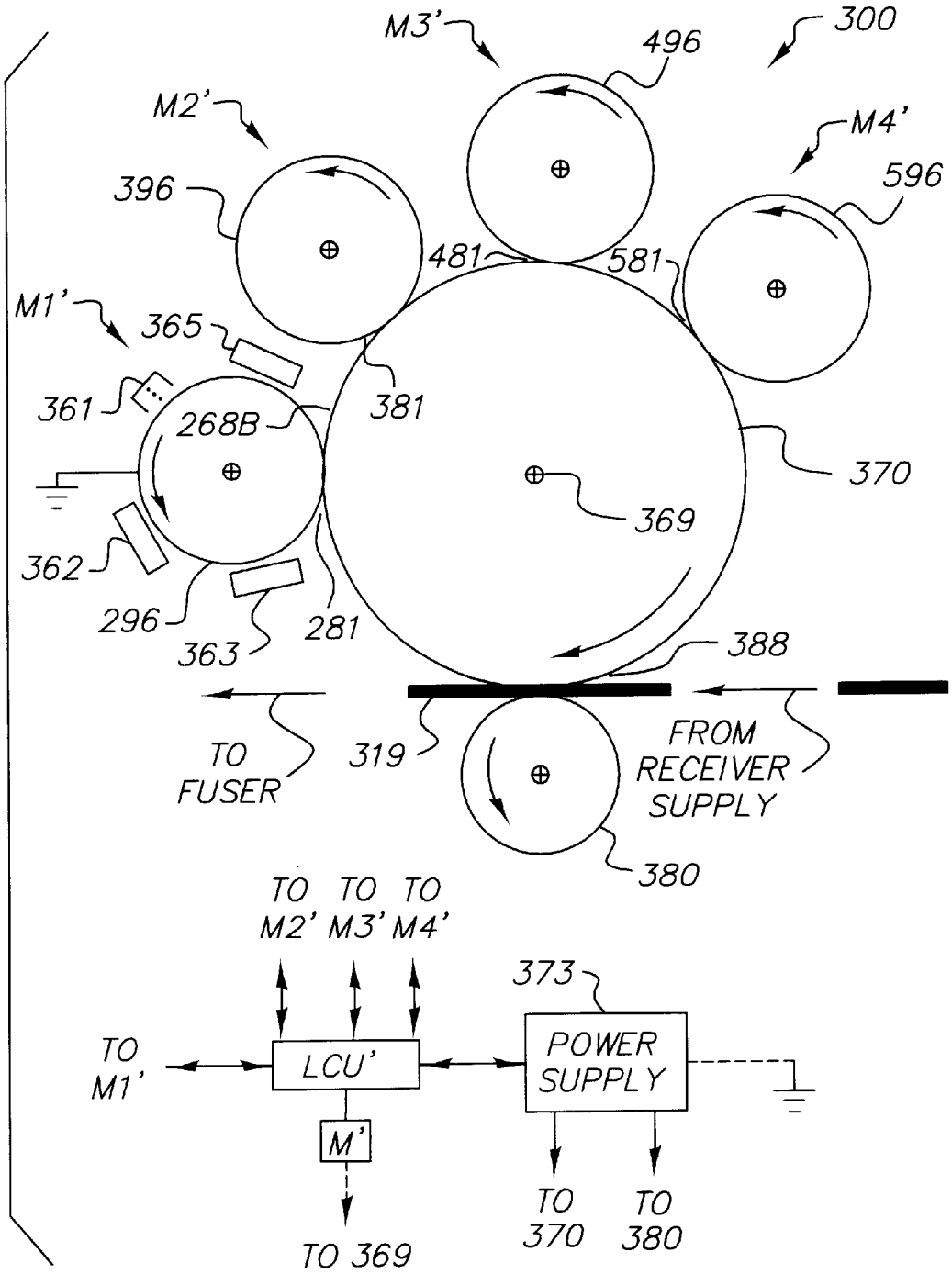
FIG. 14 is a schematic side elevational view of still yet another embodiment of an apparatus of the invention showing both specific and generalized components thereof.

In the embodiment of FIG. 14, four color modules M1', M2', M3', and M4' are shown situated about a common rotatable member or common roller 370 in the apparatus 300. Each color module is an intermediate member (IM) having zones associated therewith for forming an ink-jet-ink-derived material halftone or continuous tone color image on each corresponding IM for a respective color. Each IM 296, 396, 496, 596 forms a respective color image in a similar manner as for the IMs described above in apparatus 100 and 200, i.e., by using ink jet device 361, Image Concentrating Process Zone 362, and Excess Liquid Removal Process Zone 363. In a Regeneration Process Zone 365, IM 296 is prepared for a new primary ink jet image, in manner described above. Although not explicitly shown in FIG. 14, in alternative embodiments the Image Concentrating Process Zone 362 and the Excess Liquid Removal Process Zone 363 may be combined into a single zone, as disclosed above, e.g., with further reference to FIG. 3. Preferably, the order of color image transfer to the common roller 370 is M1'—yellow, M2'—magenta, M3'—cyan, and M4'—black. The respective ink-jet-ink-derived material images formed on the respective intermediate member rollers are each transferred preferably electrostatically as described above to the common roller 370 at a respective nip, e.g., nip 281, formed with the IM under pressure and with a suitable electrical biasing provided by power supply (PS') 373 to common roller 370, with roller 296 preferably grounded. Each color image is sequentially transferred in register to the outer surface of the common roller 370 to form a plural color image on the common roller. Drive from a motor drive M' is preferably provided to a shaft 369, and common roller 370 is frictionally engaged (nonslip) with each of the IMs 296, 396, 496, 596 under pressure. A receiver member 319 is fed from a suitable paper supply in timed relationship with the plural four-toner color ink-jet-ink-derived material image formed serially in registered superposed relationship on the common roller, the four-color image being transferred in a plural image transfer station to the receiver member at a nip 388 formed with backup roller 438. The power supply PS' provides suitable electrical biasing to backup roller 380 to induce transfer of the plural or multicolor image to the receiver member in the plural image transfer station. The receiver member is then fed to a fuser member (not shown) for fixing of the four-color ink-jet-ink-derived material image thereto as necessary. A transport belt (not shown) may be used to transport the receiver member 319 through the nip 388 wherein in the nip, the receiver member is between the common roller and the transport belt. Overdrive (or underdrive) corrections for transfer nips 281, 381, 481, 581 may be provided as described hereinabove for previous embodiments. A cleaning station (not illustrated) may be provided between nip 388 and module M1' for cleaning off any residual ink-jet ink-derived material from common roller 370. In an alternative embodiment, a web (not illustrated) may be employed instead of the common roller.

In certain alternative embodiments (not illustrated) a liquid-depleted image is not formed, e.g., a concentrated image formed in the Image Concentrating Process Zone is transferred to a receiver in a Transfer Process Zone, and no Excess Liquid Removal Zone is included in the apparatus.

Notwithstanding disclosure hereinabove relating to rotatable intermediate members, an intermediate member may in certain embodiments be a linearly-movable planar member, e.g., in the form of a plate or a platen, or, the intermediate member may mounted on a plate or a platen. In an imaging apparatus including a planar intermediate member, the planar intermediate member is moved along a linear path past various devices or process zones having characteristics similar to those described above with reference to FIGS. 2 and 3, which devices or process zones are disposed along a direction of motion of the plate or platen. Thus, in an apparatus which includes a linearly-movable planar intermediate member, the devices or process zones can be disposed sequentially in the following order: an ink jet device; an Image Concentrating Process Zone; an Excess Liquid Removal Process Zone; a Transfer Process Zone; and, a Regeneration Process Zone, wherein the ink jet device is located near a starting position for ultimately forming an image on a receiver provided in the Transfer Process Zone, and the Regeneration Process Zone is located after the Transfer Process Zone near an ending position along the direction of motion. Alternatively, the Regeneration Process Zone may be located near a starting position and the Transfer Process Zone located near the ending position. After the platen reaches the ending position, the direction of the platen is reversed and the platen is moved back to the starting position. In alternative embodiments, the Image Concentrating Process Zone and the Excess Liquid Removal Process Zone are combined into an Image Concentration/Liquid Removal Process Zone, which Image Concentration/Liquid Removal Zone is similar to that described above with reference to FIG. 3.

In embodiments above including embodiments 100, 200 and 300, any known non-electrostatic transfer process may be used as described previously above, including thermal transfer, pressure transfer and transfusing, whereupon devices such as power supplies, corona chargers and so forth such as may be used for providing a transfer electric field are not required. Furthermore, in alternative embodiments, any combination of thermal transfer, pressure transfer, or transfusing with electrostatic transfer may be used. It is to be understood that suitable modifications are to be made to the relevant materials and apparatus to enable any of these embodiments or alternative embodiments, and that any suitable particulate ink jet ink may be used, including aqueous-based or nonaqueous particulate dispersions containing charged particles, uncharged particles, electrostatically stabilized particles, or sterically stabilized particles.

The subject invention has a number of advantages over prior art. In the present invention, a nonaqueous ink jet ink may be used which can be similar to a relatively costly liquid developer employed in electrostatographic imaging technology. Such a nonaqueous ink may also be advantageously used in a more concentrated form than a liquid developer, so that a smaller volume of ink requires a removal of correspondingly less excess liquid from a concentrated image. Further advantages of a more concentrated formulation of such a nonaqueous ink include reduced shipping and storage costs. Moreover, because such an ink jet ink is not deposited in the background (Dmin) areas, image background staining such as may present a problem in liquid developer electrophotography can be avoided. In addition, use of such a nonaqueous ink in the present invention provides a much simpler imaging process than liquid developer electrophotography, inasmuch as there is no expensive photoconductor nor charging thereof required. Also, in all embodiments excepting that of apparatus 300, only one transfer is required for each ink-jet-ink-derived color of a color image, unlike two transfers per color toner image such as required in an electrophotographic engine which includes an intermediate member. By comparison with a conventional intermediate transfer member such as is typically used for electrostatic transfer in electrophotography, an intermediate member of the present invention may in certain embodiments be designed for thermal or pressure transfer, which intermediate member can be less expensive and the transfer mechanism simpler and cheaper than for electrostatic transfer. Because apparatus of the invention can, in certain embodiments, employ inks which are closely similar to, or possibly identical to, liquid developers such as are commercially used for electrostatography, and because the technology for making electrophotographic liquid developers is quite mature, the cost and difficulty of formulating new inks can be advantageously reduced. Unlike liquid developer electrophotography, an ink for use in the present invention may be aqueous-based, thereby advantageously allowing the use of presently available, aqueous-based, pigmented particulate ink jet inks, or similar inks. An aqueous-based ink for use in the present invention also has advantages over a liquid developer, i.e., low toxicity and nonflammability.

In common with certain recent ink jet technology which utilizes an intermediate member, an image receiver of the subject invention is decoupled from the ink jet device, so that a much larger variety of receivers may be used, including rough receivers, smooth receivers, porous receivers and non-porous receivers. Not only can a wide variety of receivers be used, but also image spreading can be better controlled by controlling the surface characteristics of the intermediate member as well as independently controlling the ink surface tension.

A key attribute which advantageously differentiates the subject invention from conventional ink jet technology is the ability to remove excess liquid from a primary image, thereby forming on an intermediate member a dry (or relatively dry) ink-jet-ink-derived material image for transfer to a receiver. This gives important additional advantages, including: enhanced image sharpness and less image bleeding on a receiver as compared with conventional ink jet imaging; no drying step for an image on a receiver, which drying is cumbersome and costly, especially for aqueous-based inks owing to the large latent heat of vaporization of water, and which drying may cause a receiver to curl or otherwise distort; and, an ability to recycle any removed excess liquid from a primary image, not possible with conventional ink jet imaging.

The invention has been described in detail with particular reference to certain preferred embodiments thereof, but it will be understood that variations and modifications can be effected within the spirit and scope of the invention.

What is claimed is:

1. For forming an ink-jet-ink-derived material image on an operational surface of a member and transferring said ink-jet-ink-derived material image to a receiver member, an imaging apparatus comprising:

an ink jet device for imagewise jetting, on to said operational surface of said member, droplets of an ink made of particles dispersed in a carrier fluid, said ink jet device thereby forming on said operational surface a primary image, said primary image including said particles and said carrier fluid;

a plurality of process zones associated with said operational surface of said member, said plurality of process zones located sequentially in proximity with said operational surface and said plurality of process zones including an image concentrating process zone, an excess liquid removal process zone, and a transfer process zone;

a mechanism in said image concentrating process zone for concentrating said particles of said primary image so as to form a concentrated image on said operational surface from said primary image, said mechanism for concentrating said particles causing said particles to become concentrated adjacent said operational surface;

a mechanism in said excess liquid removal process zone for removing a portion of said carrier liquid from said concentrated image so as to form on said operational surface a liquid-depleted image;

a mechanism for transferring to a receiver member, from said operational surface in said transfer process zone, said liquid-depleted image; and wherein said primary image includes a plurality of smallest resolved imaging areas and each of said plurality of smallest resolved imaging areas receives from said ink jet device a preselected number of droplets of said ink, said preselected number including zero.

2. The apparatus according to claim 1, further comprising:

a regeneration process zone included in said plurality of process zones, said regeneration process zone associated in proximity with said operational surface of said member at a location between said transfer zone and said ink jet device; and wherein said regeneration process zone is provided a mechanism for regenerating said operational surface, said regenerating preceding a subsequent formation by said ink jet device of a new primary image.

3. The apparatus according to claim 1 wherein said member is an intermediate member, which intermediate member is a rotatable member.

4. The apparatus according to claim 1 wherein said member is an intermediate member, which intermediate member is a linearly-movable member.

5. The apparatus according to claim 3 wherein said ink jet device forms on said intermediate member a half-tone primary image.

6. The apparatus according to claim 3 wherein said ink jet device forms on an intermediate member a continuous tone primary image.

7. For forming an ink-jet-ink-derived material image on an operational surface of a member and transferring said ink-jet-ink-derived material image to a receiver member, an imaging apparatus comprising:

an ink jet device for imagewise jetting, on to said operational surface, droplets of an ink made of particles dispersed in a carrier fluid, said ink jet device thereby forming on said operational surface of said member a primary image, said primary image including said particles and said carrier fluid;

a plurality of process zones associated with said operational surface of said member, said plurality of process zones located sequentially in proximity with said operational surface and said plurality of process zones including an image concentration/liquid removal process zone and a transfer process zone;

a mechanism in said image concentration/liquid removal process zone for concentrating said primary image while removing a portion of said carrier liquid so as to form on said operational surface a concentrated liquid-depleted image;

a mechanism in said transfer process zone for transferring said concentrated liquid-depleted image from said operational surface to a receiver member, and wherein said primary image includes a plurality of smallest resolved imaging areas and each of said plurality of smallest resolved imaging areas receives from said ink jet device a preselected number of droplets of said ink, said preselected number including zero.

8. The apparatus according to claim 7, further comprising:

a regeneration process zone included in said plurality of process zones, said regeneration process zone associated in proximity with said operational surface of said member at a location between said transfer zone and said ink jet device; and wherein said regeneration process zone is provided a mechanism for regenerating said operational surface, said regenerating preceding a subsequent formation by said ink jet device of a new primary image.

9. The apparatus according to claim 7 wherein said member is an intermediate member, which intermediate member is a rotatable member.

10. The apparatus according to claim 7 wherein said member is an intermediate member, which intermediate member is a linearly-movable member.

11. The apparatus according to claim 9 wherein said ink jet device forms on said intermediate member a half-tone primary image.

12. The apparatus according to claim 9 wherein said ink jet device forms on an intermediate member a continuous tone primary image.

13. The apparatus according to claim 1, wherein said mechanism for concentrating in said image concentrating process zone said particles of said primary image is a magnetic field mechanism.

14. The apparatus according to claim 1, wherein said mechanism for concentrating in said Image concentrating process zone said particles of said primary image is an electric field mechanism, which electric field mechanism includes one device selected from the following group:

a corona charging device, a contacting device including an electrode, and a non-contacting device including an electrode.

15. The apparatus according to claim 14, wherein said electric field mechanism is a corona charging device which provides corona ions of a same polarity as a polarity of said particles dispersed in said carrier fluid, which ions are directed towards said primary image so as to charge said primary image.

16. The apparatus according to claim 14 wherein said electric field mechanism is an electrode which has the same polarity as a polarity of said particles dispersed in said carrier fluid.

17. The apparatus according to claim 7 wherein said mechanism for concentrating said primary image while removing a portion of said carrier liquid includes an evaporation mechanism and a blotting mechanism.

18. The apparatus according to claim 17 wherein said blotting mechanism comprises an absorbent layer, included in said intermediate member, for imbibing said carrier liquid, said absorbent layer having an outer surface including said operational surface of said intermediate member, said particles remaining on said operational surface during said imbibing.

19. The apparatus according to claim 18 wherein said intermediate member is a roller and said blotting mechanism further comprises:

a source of vacuum which draws said carrier liquid through said absorbent layer into an interior chamber of said roller;

a vent connected to said interior chamber of said roller; and wherein said source of vacuum further draws said carrier liquid through said vent so as to remove said carrier liquid from said interior chamber.

20. The apparatus according to claim 17 wherein said evaporation mechanism includes at least one of the mechanisms selected from the following group:

an internal source of heat located within said intermediate member;

a contact with a heated member, said heated member external to said intermediate member;

a source of radiation absorbable by at least one of said intermediate member and a component of said ink included in said primary image; and an airflow.

21. The apparatus according to claim 1, wherein said mechanism for removing in said excess liquid removal process zone a portion of said carrier liquid from said concentrated image comprises a liquid-removal device, said liquid-removal device including at least one device selected from the following group:

a squeegee roller;

a squeegee blade;

a contacting blotting device;

a heating device;

a skiving device; and an air knife device.

22. The apparatus according to claim 21, wherein said liquid-removal device further includes an electrode biased by a source of voltage, which voltage has a polarity the same as a polarity of said particles included in said concentrated image.

23. The apparatus according to claim 21, wherein said liquid removal device is a contacting blotting device which comprises an external member in contact with said intermediate member, said external member including an absorbent layer for imbibing said carrier liquid while said particles remain on said operational surface of said intermediate member during said imbibing by said external member.

24. The apparatus according to claim 23 wherein said external member of said blotting device is a roller, and said contacting blotting device further comprises:

a source of vacuum which draws said carrier liquid through said absorbent layer into an interior chamber of said external member roller;

a vent connected to said interior chamber of said external member roller; and wherein said source of vacuum further draws said carrier liquid through said vent so as to remove said carrier liquid from said interior chamber.

25. The apparatus according to claim 1 wherein said ink jet ink is a colloidal dispersion of particles, said particles comprising a pigment.

26. The apparatus according to claim 3 wherein said ink jet ink is a colloidal dispersion of particles, said particles comprising a pigment.

27. The apparatus according to claim 25 wherein said pigment is finely divided and dispersed in a binder.

28. The apparatus according to claim 26 wherein said pigment is finely divided and dispersed in a binder.

29. The apparatus according to claim 1 wherein said ink jet ink includes a carrier fluid, said carrier fluid being nonaqueous.

30. The apparatus according to claim 3 wherein said ink jet ink includes a carrier fluid, said carrier fluid being nonaqueous.

31. The apparatus according to claim 29 wherein said carrier fluid has a flash point greater than or equal to about 140° F.

32. The apparatus according to claim 30 wherein said carrier fluid has a flash point greater than or equal to about 140° F.

33. The apparatus according to claim 1 wherein said ink jet ink includes a carrier fluid, said carrier fluid being aqueous-based.

34. The apparatus according to claim 3 wherein said ink jet ink includes a carrier fluid, said carrier fluid being aqueous-based.

35. The apparatus according to claim 1 wherein said ink jet ink comprises a colloidal dispersion being characterized by at least one of a steric stabilization and an electrostatic stabilization.

36. The apparatus according to claim 3 wherein said ink jet ink comprises a colloidal dispersion being characterized by at least one of a steric stabilization and an electrostatic stabilization.

37. The apparatus according to claim 1 wherein said member is an intermediate member, said intermediate member comprising:

a support;

a compliant layer formed on said support; and wherein said support includes one of a drum, a web, and a planar linearly-movable member.

38. The apparatus according to claim 3 wherein said member is an intermediate member, said intermediate member comprising:

a support;

a compliant layer formed on said support; and wherein said support includes one of a drum, a web, and a planar linearly-movable member.

39. The apparatus according to claim 1 wherein said member is an intermediate member, said intermediate member comprising an electrode biasable by a source of potential including ground potential.

40. The apparatus according to claim 3 wherein said member is an intermediate member, said intermediate member comprising an electrode biasable by a source of potential including ground potential.

41. The apparatus according to claim 39 wherein said electrode has a hill-and-valley shape.

42. The apparatus according to claim 40 wherein said electrode has a hill-and-valley shape.

43. The apparatus according to claim 37 wherein said compliant layer has a thickness in a range of approximately between 0.5 mm and 10 mm.

44. The apparatus according to claim 38 wherein said compliant layer has a thickness in a range of approximately between 0.5 mm and 10 mm.

45. The apparatus according to claim 43 wherein said compliant layer has a thickness in a range of approximately between 0.5 mm and 3 mm.

46. The apparatus according to claim 44 wherein said compliant layer has a thickness in a range of approximately between 0.5 mm and 3 mm.

47. The apparatus according to claim 37 wherein said compliant layer has a resistivity less than about $10^{10}$ ohm-cm.

48. The apparatus according to claim 38 wherein said compliant layer has a resistivity less than about $10^{10}$ ohm-cm.

49. The apparatus according to claim 47 wherein said compliant layer has a resistivity less than about $10^{7}$ ohm-cm.

50. The apparatus according to claim 48 wherein said compliant layer has a resistivity less than about $10^{7}$ ohm-cm.

51. The apparatus according to claim 37 wherein said intermediate member has an optional thin outer layer which is formed on said compliant layer.

52. The apparatus according to claim 38 wherein said intermediate member has an optional thin outer layer which is formed on said compliant layer.

53. The apparatus according to claim 51 wherein said optional thin outer layer having a thickness in a range of approximately between 1 micrometer and 20 micrometers.

54. The apparatus according to claim 52 wherein said optional thin outer layer having a thickness in a range of approximately between 1 micrometer and 20 micrometers.

55. The apparatus according to claim 51 wherein said optional thin outer layer is made from a group of materials including sol-gels, ceramers, and polyurethanes.

56. The apparatus according to claim 52 wherein said optional thin outer layer is made from a group of materials including sol-gels, ceramers, and polyurethanes.

57. The apparatus according to claim 1 wherein said ink jet ink and said operational surface form a mutual interface for which interface a value of spreading coefficient does not exceed substantially zero.

58. The apparatus according to claim 3 wherein said ink jet ink and said operational surface form a mutual interface for which interface a value of spreading coefficient does not exceed substantially zero.

59. The apparatus according to claim 1 wherein said transfer mechanism includes at least one of an electrostatic transfer mechanism, a thermal transfer mechanism, and a pressure transfer mechanism.

60. The apparatus according to claim 59 wherein a charging device is used for applying an electrostatic charge to an ink-jet-ink-derived material included in a liquid-depleted image formed in an excess liquid removal process zone, said applying preceding a transfer of said liquid-depleted image to a receiver in said transfer process zone.

61. The apparatus according to claim 59 wherein a charging device is used for applying an electrostatic charge to an ink-jet-ink-derived material included in a liquid-depleted image formed in the image concentration/liquid removal process zone, said applying preceding a transfer of said liquid-depleted image to a receiver in said transfer process zone.

62. The apparatus according to claim 2 further including a mechanism for regenerating an operational surface of a member, which mechanism for regenerating is for use in the regeneration process zone, which mechanism for regenerating an operational surface substantially removes, from said operational surface, residual material not transferred in the transfer process zone, said mechanism comprising at least one of a group of devices, said group of devices including a cleaning blade, a squeegee, a scraper for scraping said operational surface, a cleaning roller to which said residual material adheres, a cleaning brush, a solvent applicator, and a wiper.

63. The apparatus according to claim 8 further including a mechanism for regenerating an operational surface of a member, which mechanism for regenerating is for use in the regeneration process zone, which mechanism for regenerating an operational surface substantially removes, from said operational surface, residual material not transferred in the transfer process zone, said mechanism comprising at least one of a group of devices, said group of devices including a cleaning blade, a squeegee, a scraper for scraping said operational surface, a cleaning roller to which said residual material adheres, a cleaning brush, a solvent applicator, and a wiper.

64. A method of making an ink-jet-ink-derived image comprising the steps of:

using an ink jet device to form on an intermediate member an ink image formed from an ink made from particles dispersed in a liquid;

causing said particles dispersed in a liquid included in said ink image to become concentrated adjacent an operational surface of said intermediate member;

removing a portion of said liquid from said ink image so as to form a liquid-depleted ink-jet-ink-derived material image; and transferring said liquid-depleted ink-jet-ink-derived material image from said operational surface to another member.

* * * * *